US007603261B2

(12) United States Patent
Tardy

(10) Patent No.: US 7,603,261 B2
(45) Date of Patent: Oct. 13, 2009

(54) METHOD FOR PREDICTING ACID PLACEMENT IN CARBONATE RESERVOIRS

(75) Inventor: Philippe Tardy, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 321 days.

(21) Appl. No.: 11/564,584

(22) Filed: Nov. 29, 2006

(65) Prior Publication Data

US 2008/0015832 A1 Jan. 17, 2008

Related U.S. Application Data

(63) Continuation-in-part of application No. 11/456,778, filed on Jul. 11, 2006.

(51) Int. Cl.
*G06F 17/50* (2006.01)
*E21B 36/02* (2006.01)

(52) U.S. Cl. ..... 703/2; 703/5; 703/7; 703/9; 166/288; 166/303

(58) Field of Classification Search ..... 703/2, 703/5–9; 166/288, 303
See application file for complete search history.

(56) References Cited

U.S. PATENT DOCUMENTS 6,196,318 B1 3/2001 Gong
7,114,567 B2 10/2006 Chan
7,165,613 B2 1/2007 Chan
2008/0135254 A1 * 6/2008 Vinegar et al. ..... 166/303
2008/0185147 A1 * 8/2008 Vinegar et al. ..... 166/288

OTHER PUBLICATIONS

SPE 52165; M. Gong, A.M. El-Rabba; Quantitative Model of Wormholing Process in Carbonate Acidizing; Society of Petroleum Engineers; 1999; SPE Mid-Continent Operations Symposium in Oklahoma City, Oklahoma; Mar. 28-31, 1999.
SPE 27403; A.D. Hill, Ding Zhu & Yimei Wang; The Effect of Wormholing on the Fluid-Loss Coefficient in Acid Fracturing; SPE Productions & Facilities, Nov. 1995; pp. 257-263; 1994 SPE Formation Damage Symposium in Lafayette, Louisiana Feb. 7-10.
SPE 26578; Y. Wang, A.D. Hill and R.S. Schechter; The Optimum Injection Rate for Matrix Acidizing of Carbonate Formations; Society of Petroleum Engineers; 1993; 68th Annual Technical Conference and Exhibition of the Society of Petroleum Engineers in Houston, Texas; Oct. 3-6, 1993.
SPE 16887 ; G. Daccord, E. Touboul and R. Lenormand; Carbonate Acidizing: Toward a Quantitative Model of the Wormholing Phenomenon; SPE Production Engineering; 1987; SPE Annual Technical Conference Exhibition in Dallas, Texas; Sep. 27-30, 1987.

(Continued)

*Primary Examiner*—Thai Phan
(74) *Attorney, Agent, or Firm*—Robin Nava; Dave Cate; Rachel Greene

(57) ABSTRACT

A computationally efficient general method of modeling or simulating matrix acidizing treatment when flow is not axisymmetric involves determining streamlines in the general flow field using complex potential theory to solve for the flow along the streamlines. The flow over a time step is used to model the propagation of the acid front and the creation and extension of wormholes.

7 Claims, 17 Drawing Sheets

OTHER PUBLICATIONS

SPE 38166; Marten A. Buijse; Understanding Wormholing Mechanisms Can Improve Acid Treatments in Carbonate Formations; Society of Petroleum Engineers; 1997; SPE European Formation Damage Conference in The Hague, the Netherlands; Jun. 2-3, 1997.

SPE 16886; K.M. Hung, A.D. Hill and K. Sepehrnoorl; A Mechanistic Model of Wormhole Growth in Carbonate Matrix Acidizing and Acid Fracturing; Journal of Petroleum Technology; 1987; SPE Annual Technical Conference and Exhibition in Dallas, Texas; Sep. 27-30, 1987.

SPE 68922; F. Golfier, B. Bazin; C. Zarcone; R. Lernormand, D. Lasseux and M. Quintard; Acidizing Carbonate Reservoirs: Numerical Modelling of Wormhole Propagation and Comparison to Experiments; 2001; SPE European Formation Damage Conference in The Hague in the Netherlands; May 21-22, 2001.

SPE 86504; Bernhard Lungwitz, Chris Fredd, Mark Brady, Matthew Miller, Syed Ali & Kelly Hughes; Diversion and Cleanup Studies of Viscoelastic Surfactant-Based Self-Diverting Acid; Society of Petroleum Engineers; 2004; SPE International Symposium and Exhibition on Formation Damage Control in Lafayette, Louisiana; Feb. 18-20, 2004.

SPE 77369; Mohan K.R. Panga, Vemuri Balakotaiah and Murtaza Ziauddin; Modeling, Simulation and Comparison of Models for Wormhole Formation during Matrix Stimulation of Carbonates; 2002; SPE Annual Technical Conference and Exhibition in San Antonio, Texas; Sep. 29-Oct. 2, 2002.

SPE 86517; Mohan K.R. Panga, Murtaza Ziauddin, Ramakrishna Gandikota and Vemuri Balakotaiah; A New Model for Predicting Wormhole Structure and Formation in Acid Stimulation of Carbonates; 2004; SPE International Symposium and Exhibition on Formation Damage Control in Lafayette, Louisiana; Feb. 18-20, 2004.

G. Daccord, R. Lenormand and O. Lietard; Chemical Dissolution of a Porous Medium by a Reactive Fluid;—I. Model for the "Wormholing" Phenomenon; Chemical Engineering Science; 1992; pp. 169-178; vol. 48 No. 1; Pergamon Press Ltd.; Printed in Great Britain.

G. Daccord, O. Lietard and R. Lenormand; Chemical Dissolution of a Porous Medium by a Reactive Fluid—II. Convection vs. Reaction, Behavior Diagram; Chemical Engineering Science; 1993; pp. 179-186; vol. 48 No. 1; Pergamon Press Ltd.; Printed in Great Britain.

F. Golfier, C. Zarcone, B. Bazin, R. Lenormand, D. Lasseux and M. Quintard; On the Ability of a Darcy-Scale Model to Capture Wormhole Formation During the Dissolution of a Porous Medium; J. Fluid Mech.; 2002; pp. 213-254; vol. 457; Cambridge University Press; Printed in the United Kingdom.

Gerard Daccord; Chemical Dissolution of a Porous Medium by a Reactive Fluid; The American Physical Society; 1987; pp. 479-482; vol. 58 No. 5; Dowell-Schlumberger; 42003 Saint Etienne Cedex 1, France.

* cited by examiner

METHOD FOR PREDICTING ACID PLACEMENT IN CARBONATE RESERVOIRS

CROSS-REFERENCE TO RELATED APPLICATIONS

This application is a continuation-in-part of U.S. patent application Ser. No. 11/456,778, "Flow of Self-Diverting Acids in Carbonate Reservoirs", filed on Jul. 11, 2006. The disclosure of the above application is incorporated herein by reference.

FIELD OF THE INVENTION

The invention relates to acid stimulation of hydrocarbon bearing subsurface formations and reservoirs. In particular, the invention relates to methods of optimizing field treatment of the formations.

BACKGROUND

Matrix acidizing is a process used to increase the production rate of wells in hydrocarbon reservoirs. It includes the step of pumping an acid into an oil- or gas-producing well to increase the permeability of the formation through which hydrocarbon is produced and to remove some of the formation damage caused by the drilling and completion fluids and drill bits during the drilling and completion process.

The procedural techniques for pumping stimulation fluids down a wellbore to acidize a subterranean formation are well known. The person who designs such matrix acidizing treatments has available many useful tools to help design and implement the treatments, one of which is a computer program commonly referred to as an acid placement simulation model (a.k.a., matrix acidizing simulator, wormhole model). Most if not all commercial service companies that provide matrix acidizing services to the oilfield have one or more simulation models that their treatment designers use. One commercial matrix acidizing simulation model that is widely used by several service companies is known as StimCADE™. This commercial computer program is a matrix acidizing design, prediction, and treatment-monitoring program that was designed by Schlumberger Technology Corporation. All of the various simulation models use information available to the treatment designer concerning the formation to be treated and the various treatment fluids (and additives) in the calculations, and the program output is a pumping schedule that is used to pump the stimulation fluids into the wellbore. The text "Reservoir Stimulation," Third Edition, Edited by Michael J. Economides and Kenneth G. Nolte, Published by John Wiley & Sons, (2000), is an excellent reference book for matrix acidizing and other well treatments.

Various mathematical models have been proposed in order to represent the flow of acid within the carbonate formations around the wellbore and the subsequent dissolution of the rock matrix where acid has invaded. Then, according to the prediction of these models, engineers can estimate how much the well will produce after treatment and, therefore, estimate whether a given treatment design will lead to the targeted production increase and optimize the design accordingly. The models proposed in the literature are developed to represent acid flow in radial flow, i.e. axisymmetric, conditions as could be observed in some particular conditions. But axisymmetric flow conditions are not always present. It would be a major advance to provide

- a criterion to determine under which radial flow, i.e. axisymmetric flow, is relevant,
- a method to solve acid flow when acid flow around the wellbore is not axisymmetric.

SUMMARY

A computationally efficient general method of modeling or simulating matrix acidizing treatment when flow is not axisymmetric involves determining streamlines in the general flow field using complex potential theory to solve for the flow along the streamlines. The flow over a time step is used to model the propagation of the acid front and the creation and extension of wormholes.

For self diverting acids, the flow along the streamlines is solved with the use of flow parameters $\Theta_r$ and $\Delta p_r$ derived from core flood experiments.

Methods of optimizing matrix acidizing treatment involve doing the calculations in an optimization loop based on user input of operational parameters and parameters associated with the geological formation and acidizing fluid.

DESCRIPTION

Figure 1:
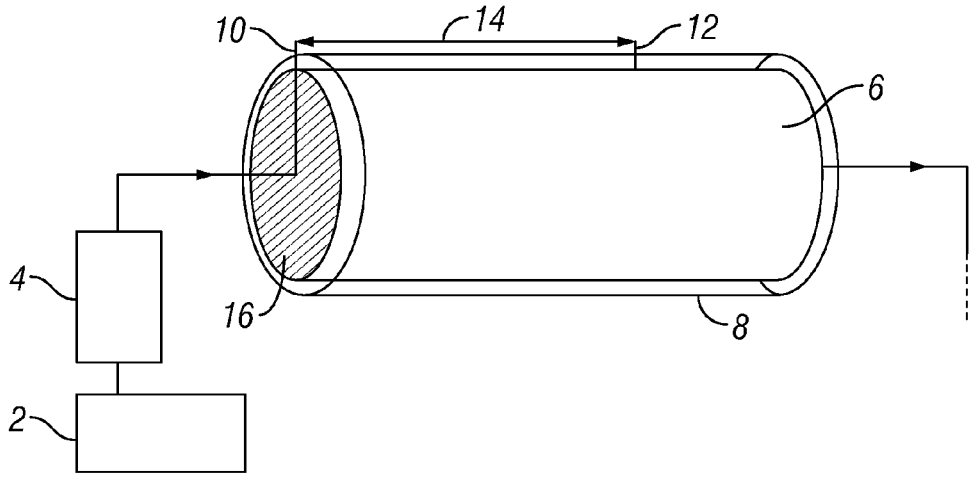
FIG. 1 shows a typical experimental apparatus for acid injection into a rock core.

In order to predict the outcome of the pumping of an acid, or of acid stages, into a reservoir, engineers go through a design process, which can be divided into several steps. In the first step, different acids are injected, for testing, into cylindrical rock cores, under various conditions. FIG. 1 is an illustration of a typical experimental setup used for injecting acid into a core. A pump [2] pumps a fluid, for example an acid, through an accumulator [4] into a core [6] held in a core holder [8]. During such tests, the following parameters will normally be varied:

Injection rate: Q

Temperature: T

Acid formulation: Ac

Rock type: Ro

As acid flows into the rock, it dissolves part of the rock matrix and increases the overall permeability of the core with time. Depending on the combination of the above parameters, the dissolution pattern inside the rock can vary between face dissolution (also known as compact dissolution), wormholing dissolution, and uniform dissolution. These three dissolution regimes give rise to different acid efficiencies. Acid efficiency is measured as the amount of acid that is required by the rock core to increase its permeability to a pre-set value $k_w$, for instance 100 times larger than the initial permeability $k_0$ of the sample. The smaller this volume of acid is, the higher the efficiency is. The moment at which this target value of permeability increase is reached is called the breakthrough time, $t_0$. The corresponding volume of acid is called the breakthrough volume, $Vol_0$.

The measure of pore volumes to breakthrough, denoted $\Theta_0$, (i.e. the breakthrough volume divided by the pore volumes of the core PV (the volume of fluid that can be contained in the core), and its use to predict acid performance during a treatment job has been known to the industry for a long time. If we define Vol as being the geometrical volume of the core and $\phi_0$ the initial porosity of the core (i.e. the fraction of the core volume that can be occupied by a fluid through the pore space network), these parameters are linked to each other as follows:

$$\Theta_0 = \frac{Vol_0}{PV} = \frac{Qt_0}{PV} \text{ where } PV = \phi_0 \times Vol \quad (1)$$

Pore volume to breakthrough has widely been used as a measure of the velocity at which wormholes propagate into the formation, under various conditions such as mean flow-rate Q, temperature T, rock-type Ro, and acid formulation Ac.

In one embodiment, a method for solving the flow of acid from a wellbore segment to a corresponding reservoir layer during a matrix acidizing simulation, comprising:

(a) Defining the initial geometry of the domain in which the flow problem is to be solved;

(b) Determining the complex potential associated with the flow problem in the domain under consideration;

(c) Determining streamlines from the complex potential in the domain under consideration;

(d) Using the streamlines to solve flow over a time step $\delta t$ to propagate acid within the domain and update wormhole extent;

(e) Updating the definition of the domain according to wormhole extent;

(f) Updating the time; and (g) Iterating as desired from step b).

In another embodiment, a method of optimizing acid treatment of a hydrocarbon containing carbonate reservoir includes carrying out linear core flood experiments varying one or more parameters selected form the group consisting of acid formulation, rock type, flow rate, and temperature;

deriving the following functions from the experiments, as a function of the parameters:

$\Theta_o$—the pore volume to wormhole/dissolution front breakthrough; and, if the acid formulation is a self-diverting acid:

$\Theta_r$—the pore volume to resistance zone breakthrough; and $\Delta p_r$—the pressure drop at resistance zone breakthrough;

solving the flow of acid from a wellbore segment to a corresponding reservoir layer during a matrix acidizing simulation by a process comprising:

defining the initial geometry of the domain in which the flow problem is to be solved;

determining the complex potential associated with the flow problem in the domain under consideration;

determining streamlines from the complex potential in the domain under consideration;

using the streamlines to solve flow over a time step $\delta t$ to propagate acid within the domain and update wormhole extent;

using the simulator in an optimization loop together with known and/or estimated reservoir parameters; and calculating at least one of the following from the simulator optimization loop:

stage and rate volumes of the acid treatment;

fluid selection for the acid treatment;

wormhole invasion profile; and skin profile.

The simulator is used to model matrix acidizing in the geologic formations of interest. Based on the calculations, treatment conditions can be selected for use in the field to enhance production of oil or gas from the geologic formation.

Figure 2A:
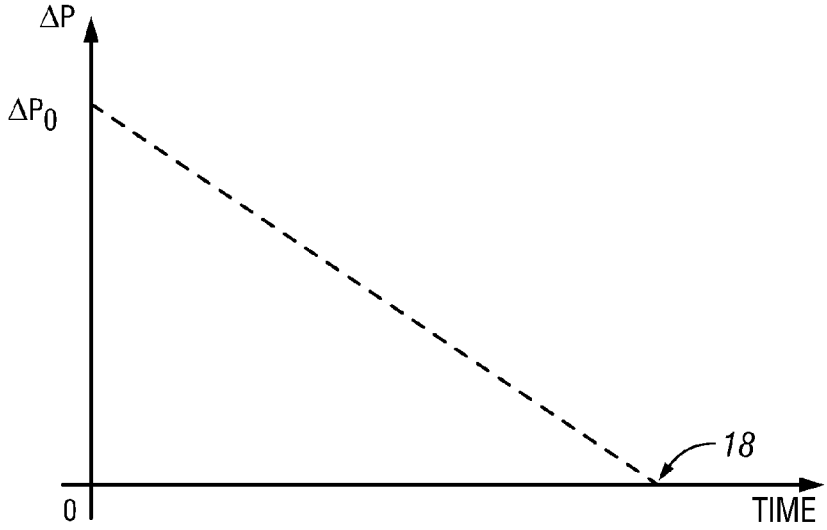
FIG. 2 illustrates the pressure-drop evolution for non-diverting acid systems such as HCl. 2A: schematic, 2B: actual data.
Figure 2B:
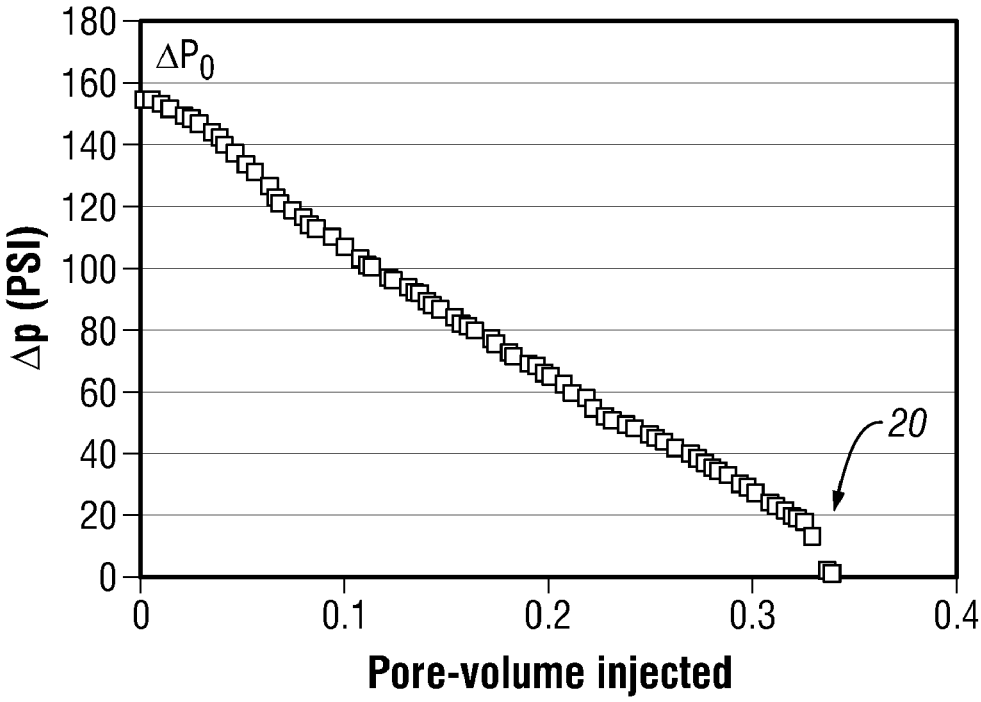

Typically, multiple pressure taps are installed down the length of the core holder; FIG. 1 shows an inlet pressure tap [10], that has an inlet pressure $p_i$, and a second pressure tap [12], that has a pressure away from the inlet $p_L$, at a distance [14], denoted L, from the inlet. The cross sectional area of the core, A, for example at the core face, is shown at [16]. In order to measure pore-volume to breakthrough for a non-self diverting acid, acid is pumped at a constant rate Q and the pressure drop $\Delta p$ across the core is monitored. The initial pressure drop when the acid reaches the inlet core face is called $\Delta p_0$. Then, as acid flows into the core, the pressure drop declines mostly linearly as illustrated in FIG. 2A, in which the breakthrough time, $t_o$, is shown at [18], and in FIG. 2B in which the pore-volume to breakthrough, $\Theta_0$, is shown at [20]. When $\Delta p$ is virtually equal to 0 (i.e., the core permeability has reached a value $k_w$ orders of magnitude larger than the initial permeability $k_0$) the pore-volume injected is recorded as the pore-volume to breakthrough $\Theta_0$.

Figure 3A:
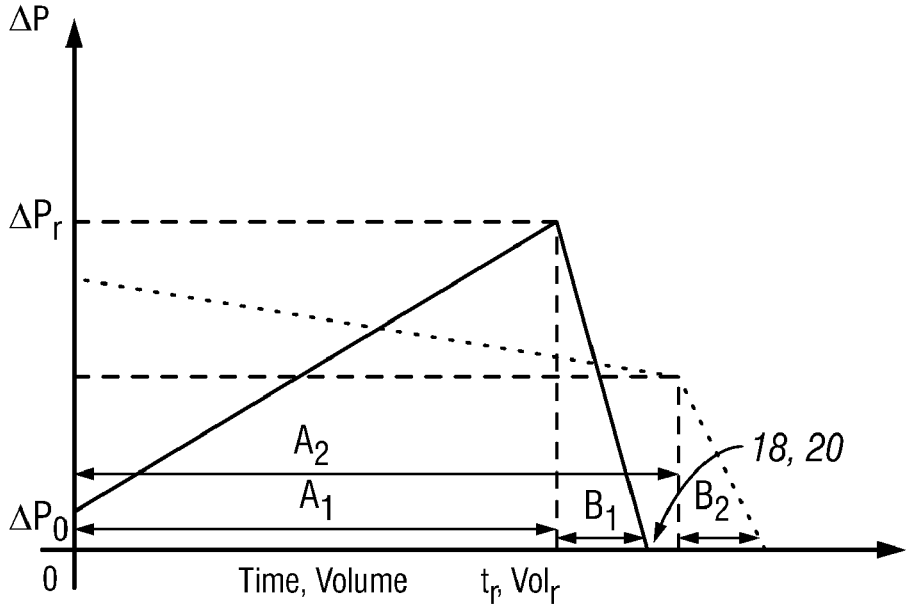
FIG. 3 illustrates the pressure drop evolution for self-diverting acid systems such as VDA™. 3A: schematic, 3B: example of actual data.

More recently, new acid systems, also known as self-diverting acids such as Viscoelastic Diverting Acid (VDA™), have been used to improve the performance of more classical acid systems such as HCl or organic acids. When such systems are pumped using the same procedure as the one described above, very different Δp behavior can be observed, as is illustrated in FIG. 3. FIG. 3*a* illustrates the development of Δp with time of pumping (or equivalently, with volume pumped) at a constant rate for two arbitrary systems designated A and B. Results with one self-diverting acid 1, in rock $R_1$, at temperature $T_1$, and rate $Q_1$, are shown by the solid line; results with another self-diverting acid 2, in rock $R_2$, at temperature $T_2$, and rate $Q_2$, are shown by the dotted line.

One important difference is that Δp may increase and then decrease with time or decrease in two regimes at different rates. In particular, it is observed that Δp has a piece-wise linear evolution. First, Δp evolves according to a first linear relationship with time (or equivalently with volume or pore volume injected) in the regions marked as A1 and A2 for two illustrative fluids. Then, at a certain time $t_r$, (or volume $Vol_r$) it switches to a second linear behavior, as depicted by B1 and B2 in FIG. 3*a*. Associated with this behavior, we define two new parameters $\Delta p_r$ (see FIG. 3*a*) and the number of pore-volumes to reach $\Delta p_r$, denoted $\Theta_r$. $\Delta p_r$ is defined as the value of Δp when Δp switches from the first to the second linear trend at time $t_r$. The parameter $\Theta_r$ is given by:

$$\Theta_r = \frac{Vol_r}{PV} = \frac{Qt_r}{PV} \tag{2}$$

where PV is the pore volume of the core, measured by known methods to determine the volume of liquid held in the core at saturation.

Figure 3B:
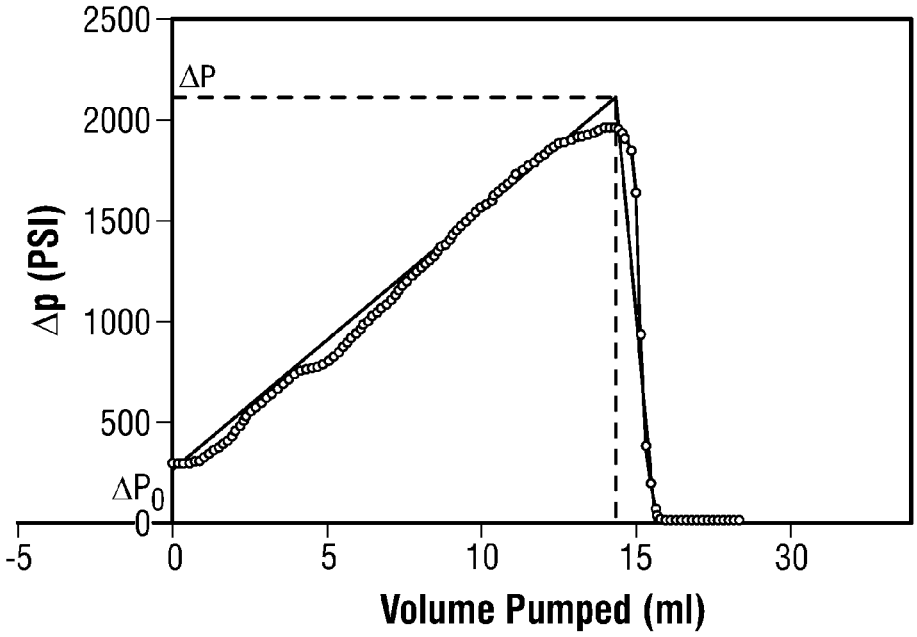

These two parameters constitute a means of predicting the performance of self-diverting acids when used in mathematical models and algorithms as will be explained below. Real data are shown in FIG. 3*b*.

Figure 4:
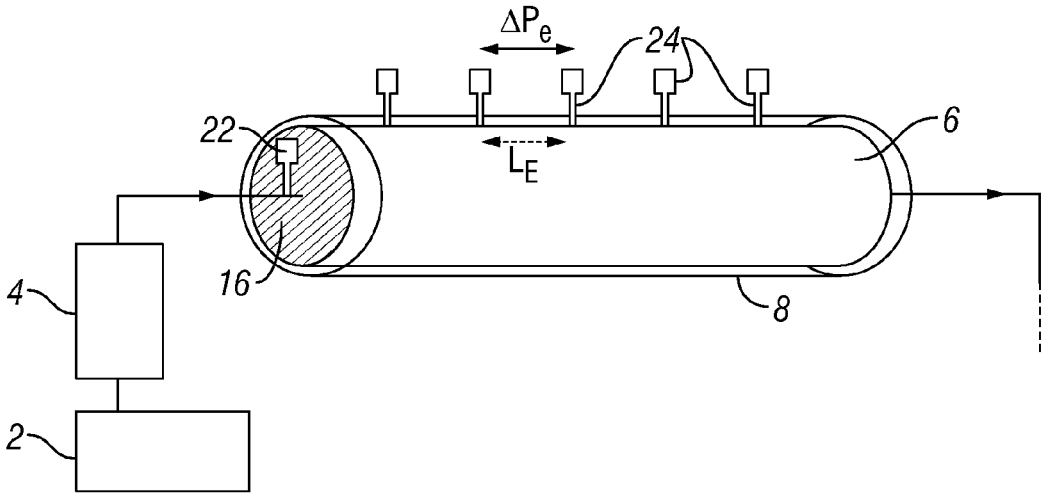
FIG. 4 shows a multi pressure tap/transducer core-flooding apparatus.

Additional experiments have shown that the pressure drop evolution described in FIG. 3, and obtained for self-diverting acid, is due to the existence of a region of low fluid mobility propagating ahead of the wormholes, or ahead of the dissolutions fronts in general. For illustration, a setup as in FIG. 1 is fitted with multiple pressure taps and transducers to measure the pressure along the core during the acid injection experiments, local pressure drops $\Delta p_e$ along the core can be measured. Such a new experimental setup is represented in FIG. 4, in which the inlet pressure tap and transducer is shown at [22] and additional pressure taps and transducers at distances down the core holder are shown at [24].

For a given pair of successive transducers (taps), $L_e$ is the distance between the two taps, $k_e$ is the permeability of the core and $\mu_e$ is the fluid viscosity between the two taps. According to Darcy's law regarding fluid flow, the measured parameters are interrelated:

$$Q = \frac{Ak_e}{\mu_e}\frac{\Delta p_e}{L_e} \tag{3}$$

where A is the cross sectional area of the core and Q is the rate of fluid flow. The fluid mobility $M_e$ is defined as:

$$M_e = \frac{k_e}{\mu_e} \tag{4}$$

With the apparatus in FIG. 4, one can:

measure $\Delta p_e$ for every pair of transducers, against time, and use equations (3) and (4) to determine the fluid mobility $M_e$ between every pair of transducers, against time From the knowledge of $M_e$ at any time, either an effective viscosity or an effective permeability can also be determined:

assuming the core permeability $k_0$ is unchanged, equation (4) gives $$\mu_e = \frac{k_0}{M_e} \tag{5}$$

assuming the acid viscosity μ is known, equation (4) gives:

$$k_e = \mu M_e \tag{6}$$

Figure 5:
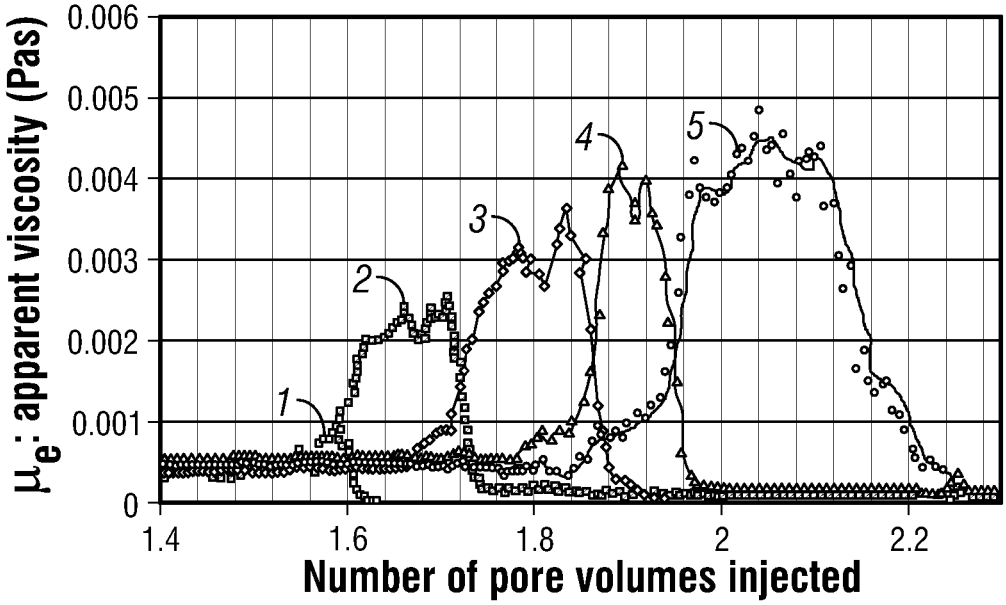
FIG. 5 shows the evolution of the effective viscosity $\mu_e$ with the number of pore volumes injected for a self-diverting acid.

The effective viscosity $\mu_e$ of the fluid flowing between pairs of transducers can be monitored against time, or equivalently, against the number of pore volumes injected. The results of one example of such monitoring are illustrated in FIG. 5. The five curves labeled 1, 2, 3, 4, and 5 in FIG. 5 are the values of $\mu_e$ calculated from equations (3), (4), and (5) at the five locations $L_e$ in FIG. 4.

Line number 1 (see FIG. 5) corresponds to the zone between the core inlet and the first pressure tap on the core. Line number 2 corresponds to the zone between the first and second pressure taps on the core. The other lines represent the remaining successive pairs in order.

Figure 6:
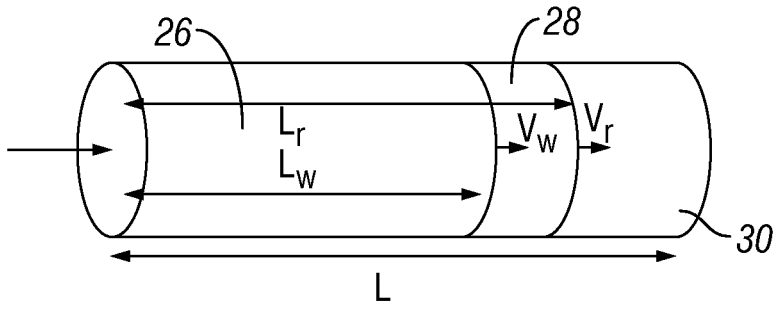
FIG. 6 illustrates a flow pattern in the core when a self diverting acid is pumped.

From FIG. 5, it can be seen that, as the self-diverting acid flows into the core, a first zone of finite effective viscosity $\mu_e$ propagates along the core (observed from the viscosity peaks) followed be a zone of virtually zero effective viscosity, or equivalently (using equation (4)), a zone of very large effective permeability $k_e$. The flow pattern in the core when acid is being pumped (from left to right as shown in the figure) can therefore be represented as in FIG. 6.

The zone of high fluid mobility [26] can be parameterized by an effective fluid mobility $M_e = M_w$ and a propagation velocity $V_w$. Equivalently, the zone can also be characterized by an effective fluid viscosity $\mu_w$ or an effective permeability $k_w$, derived according to equation (4).

Similarly, the zone of resistance or low fluid mobility [28] can be parameterized by an effective fluid mobility $M_e = M_r$ (and therefore according to Equation 4 an effective fluid viscosity $\mu_e = \mu_r$ or an effective permeability $k_e = k_r$), as well as a propagation velocity $V_r$. Finally, there is a zone of displaced fluid [30] that was originally in the core prior to injection.

The velocities can be determined as follows $$\begin{cases} V_w((Q/A), T, Ro, Ac) = \left(\frac{Q}{A}\right)\frac{1}{\theta_0((Q/A), T, Ro, Ac)} \\ V_r((Q/A), T, Ro, Ac) = \left(\frac{Q}{A}\right)\frac{1}{\theta_r((Q/A), T, Ro, Ac)} \end{cases} \tag{7}$$

The parentheses indicate that the velocities and pore volumes to breakthrough are themselves functions of fluid velocity Q/A, temperature T, rock formation Ro, and acid formulation Ac. The functions $\Theta_0$ and $\Theta_r$ are determined experimentally from the core flood experiments.

Using effective viscosities to express the effective mobilities, and rearranging the formulae, the effective viscosity $\mu_r$ is given by (8), and the derivation of (8) is given below.

$$\mu_r = \mu_d \frac{\Delta p_r}{\Delta p_0}\frac{\Theta_0}{\Theta_0 - \Theta_r} \tag{8}$$

Where $\mu_d$ is the viscosity of the displaced fluid, originally saturating the core before acid is injected; $\Delta p_0$ is the value of the pressure drop across the core when only the displaced fluid is pumped at the same conditions (typically brine). (8) is derived as follows. Let $L_w$ be the distance traveled by the wormholes, measured from the core inlet, during the core-flood experiment, where the fluid mobility is $M_w$ (see FIG. 6). Let $L_r$ be the distance traveled by the front of low fluid mobility, where the fluid mobility is $M_r$ (see FIG. 6). At the moment when $L_r$=L, L being the length of the core, $\Delta p_r$ is measured and using Darcy's law, we find that, $$\Delta p_r = Q\frac{\mu_r}{Ak_0}(L - L_w) = Q\frac{\mu_r}{Ak_0}L\left(1 - \frac{\Theta_r}{\Theta_0}\right), \tag{9}$$

and since, by definition, $$\Delta p_0 = Q\frac{\mu_d}{Ak_0}L, \tag{10}$$

we then find (8) by simple algebra.

For the zone of high fluid mobility, we find that the effective fluid viscosity $\mu_e$=$\mu_w$ in this region can be expressed as:

$$\mu_w = \mu_d\frac{\Delta p_{bt}}{\Delta p_0} \tag{11}$$

where $\Delta p_{bt}$ is the value of $\Delta p$ when the wormholes have broken through the outlet face of the core (this is the final value of $\Delta p$). (11) is derived as follows. When, $L_w$=L, L being the length of the core, $\Delta p_{bt}$ is measured. Using Darcy's law, we then find that, $$\Delta p_{bt} = Q\frac{\mu_w}{Ak_0}L \tag{12}$$

then, using (10) and (12), we find (11) by simple algebra.

Equivalently, (8) and (11) can be used to define an effective mobility or an effective permeability in each zone, using Equation (4). This leads to equation (13).

$$\begin{cases} M_r = \dfrac{k_0}{\mu_d\dfrac{\Delta p_r}{\Delta p_0}\dfrac{\Theta_0}{\Theta_0 - \Theta_r}} \\ M_w = \dfrac{k_0}{\mu_d\dfrac{\Delta p_{bt}}{\Delta p_0}} \end{cases} \quad \begin{cases} k_r = \dfrac{k_0}{\dfrac{\mu_d}{\mu}\dfrac{\Delta p_r}{\Delta p_0}\dfrac{\Theta_0}{\Theta_0 - \Theta_r}} \\ k_w = \dfrac{k_0}{\dfrac{\mu_d}{\mu}\dfrac{\Delta p_{bt}}{\Delta p_0}} \end{cases} \tag{13}$$

Figure 7A:
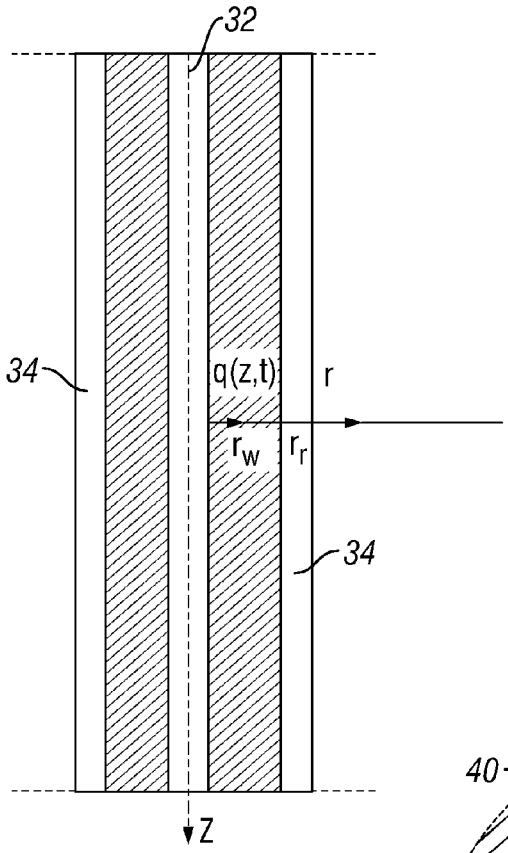
FIGS. 7*a* and 7*b* illustrate axisymmetric flow around a wellbore.
Figure 7B:
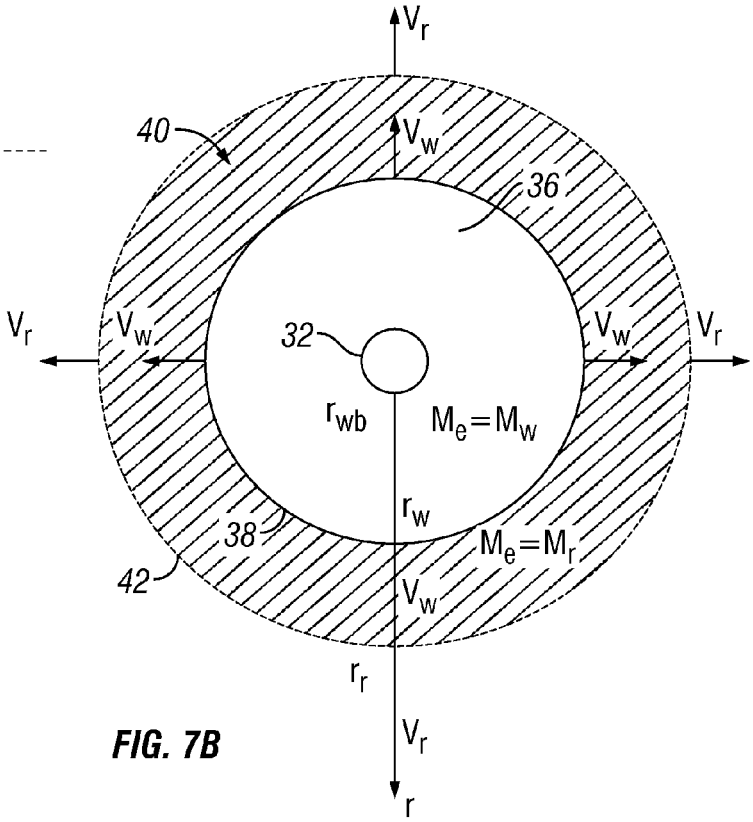

The use of Equations (8) and (11) in the case of axisymmetric radial flow around the wellbore in the reservoir as illustrated in FIGS. 7A and 7B. A wellbore [32] passes through a reservoir [34] and connects first to a wormholed or dissolved zone [36], bounded by a wormhole tip or dissolution front [38], and then to a resistance zone [40], bounded by a resistance zone front [42].

In FIGS. 7A and 7B, q(z,t) is the flow-rate per unit height into the reservoir at a time t, at a distance z along the wellbore. Let $r_w(z,t)$ be the radius of the wormhole-tip front or dissolution front and let $r_r(z,t)$ be the radius of the front of the resistance zone, both at the same time t and depth z. The evolution with time of both radii is then determined by solving the following set of equations.

$$\begin{cases} \dfrac{\partial}{\partial t}(r_w(z,t)) = \dfrac{V_w(V(z,r_w), T(z,r_w), Ro(z,r_w), Ac(z,r_w))}{\Phi_0(z,r_w)} \\ V(z,r_w) = \dfrac{q(z,t)}{2\pi r_w(z,t)} \end{cases} \tag{14}$$

$$\begin{cases} \dfrac{\partial}{\partial t}(r_r(z,t)) = \dfrac{V_r(V(z,r_r), T(z,r_r), Ro(z,r_r), Ac(z,r_r))}{\Phi_0(z,r_r)} \\ V(z,r_r) = \dfrac{q(z,t)}{2\pi r_r(z,t)} \end{cases} \tag{15}$$

Equations (14) and (15) are integrated by numerical means. Solving (14) and (15) allows the tracking of the wormhole tip and low-mobility front, respectively. In order to compute the pressure profile in the treated zone, i.e. at any z and for r between $r_{wb}$ and $r_r$, ($r_{wb}$ is the wellbore radius at the depth z and therefore the pressure in the wellbore during the treatment, we make use of $\mu_r$ as follows:

$$\begin{cases} V(z,r,t) = \dfrac{q(z,t)}{2\pi r} = -\dfrac{k_e(z,r,t)}{\mu_e(z,r,t)}\dfrac{\partial}{\partial r}p(z,r,t) \\ \mu_e(z,r,t) = \begin{cases} \mu & \text{if } r_{wb}(z) < r < r_w(z,t) \\ \mu_r & \text{if } r_w(z,t) < r < r_r(z,t) \end{cases} \\ k_e(z,r,t) = \begin{cases} k_w & \text{if } r_{wb}(z) < r < r_w(z,t) \\ k_0 & \text{if } r_w(z,t) < r \end{cases} \end{cases} \tag{16}$$

Equations (14)-(16) are integrated by analytical or numerical means and allow calculation of the pressure drop between the wellbore and $r_r$, anywhere along the wellbore. The pressure at the wellbore $p(z,r_{wb},t)$ can be determined from the pressure $p(z,r_r,t)$ at the resistance front using the following formula.

$$\begin{cases} p(z,r_{wb},t) = p(z,r_w,t) + \ln\left(\dfrac{r_w}{r_{wb}}\right)\dfrac{q(z,t)\mu}{2\pi k_w} \\ p(z,r_w,t) = p(z,r_r,t) + \ln\left(\dfrac{r_r}{r_w}\right)\dfrac{q(z,t)\mu_r}{2\pi k_0} \end{cases} \tag{17}$$

In (16) and (17), it is possible to substitute the effective viscosity $\mu_r$ and the effective permeability $k_w$ with other combinations giving rise to the same fluid mobility, for instance, (16) is equivalent to (18) and (17) to (19).

$$\begin{cases} V(z,r,t) = \dfrac{q(z,t)}{2\pi r} = -M(z,r,t)\dfrac{\partial}{\partial r}p(z,r,t) \\ M(z,r,t) = \begin{cases} M_w & \text{if } r_{wb}(z) < r < r_w(z,t) \\ M_r & \text{if } r_w(z,t) < r < r_r(z,t) \end{cases} \end{cases} \tag{18}$$

$$\begin{cases} p(z,r_{wb},t) = p(z,r_w,t) + \ln\left(\dfrac{r_w}{r_{wb}}\right)\dfrac{q(z,t)}{2\pi M_w} \\ p(z,r_w,t) = p(z,r_r,t) + \ln\left(\dfrac{r_r}{r_w}\right)\dfrac{q(z,t)}{2\pi M_r} \end{cases} \tag{19}$$

For the case of non-axisymmetric flow, whether for a self-diverting acid or a non-self-diverting acid, the following are considered. First criteria are developed to predict when flow is essentially axisymmetric and can thus be approximated accurately with a simple axisymmetric model. Next, a general method of modeling non-axisymmetric flow is provided that is applicable to both kinds of acids.

The velocity field observed during fluid flow in porous media is known to obey Darcy's law:

$$\begin{cases} \vec{V}(t, x, y, z) = -K(x, y, z)\dfrac{\vec{\nabla} p(t, x, y, z)}{\mu} \\ K(x, y, z) = \begin{bmatrix} k_{xx}(x, y, z) & k_{xy}(x, y, z) & k_{xz}(x, y, z) \\ k_{yx}(x, y, z) & k_{yy}(x, y, z) & k_{yz}(x, y, z) \\ k_{zx}(x, y, z) & k_{zy}(x, y, z) & k_{zz}(x, y, z) \end{bmatrix} \end{cases} \tag{20}$$

where $\vec{V}$ is the Darcy velocity of the fluid in the matrix;

$\mu$ is the viscosity of fluid saturating the matrix p is the pressure in the fluid;

K is the permeability tensor

When the x-axis and the y-axis are contained within the bedding plane of the rock formation, and assuming that for a given depth z, the permeability of the rock does not vary within a plane parallel to the bedding plane, the permeability tensor K is often simplified to the following expression.

$$K(x, y, z) = \begin{bmatrix} k_h(z) & 0 & 0 \\ 0 & k_h(z) & 0 \\ 0 & 0 & k_v(z) \end{bmatrix} \tag{21}$$

$k_h$ is known as the horizontal permeability $k_v$ is known as the vertical permeability The horizontal permeability $k_h$ and the vertical permeability $k_v$ are classical petrochemical properties of a rock formation. They are conventionally measured during core flood experiments or from logs.

From (20) and (21), the velocity vector of the fluid flowing from the wellbore into the rock, at a depth z, will have three components, $V_x$, $V_y$ and $V_z$.

$$V_x = -\frac{k_h}{\mu}\frac{\partial p}{\partial x} \tag{22}$$

$$V_y = -\frac{k_h}{\mu}\frac{\partial p}{\partial y}$$

$$V_z = -\frac{k_v}{\mu}\frac{\partial p}{\partial z}$$

Figure 8:
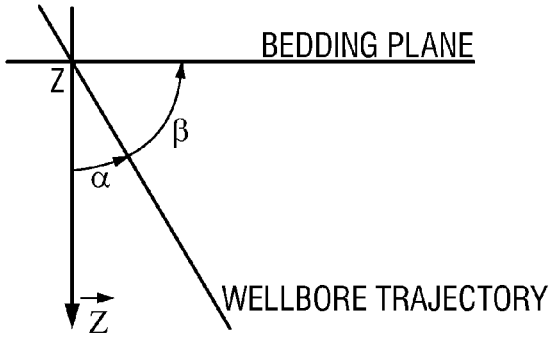
FIG. 8 shows a wellbore trajectory in a bedding plane.

We assume that the wellbore trajectory forms an angle denoted $\beta$ with the bedding plane at depth z, as illustrated in FIG. 8.

Since the pressure gradient along the wellbore is always small compared to the pressure gradients perpendicular to the wellbore, we find, $$\begin{cases} v_h(r = r_{wb}) = \sqrt{V_x^2(r = r_{wb}) + V_y^2(r = r_{wb})} \\ \qquad = \left|\cos(\alpha)\dfrac{k_h}{\mu}\dfrac{\partial p}{\partial r}(r = r_{wb})\right| \\ v_v(r = r_{wb}) = |V_z|(r = r_{wb}) \\ \qquad \left|\sin(\alpha)\dfrac{k_h}{\mu}\dfrac{\partial p}{\partial r}(r = r_{wb})\right| \end{cases} \tag{23}$$

where, $\alpha$ is the angle between the wellbore trajectory and the downwards normal to the bedding plane: $\alpha+\beta=\pi 2$ r is the radial distance away from the wellbore center $r_{wb}$ is the wellbore radius $v_h$ is the modulus of the velocity vector $(V_x, V_y)$ $v_v$ is the absolute value of $V_z$, the vertical component of velocity vector According to (23), it is possible to derive a criterion to determine whether the flow will take place mostly in planes parallel to the bedding or in planes perpendicular to the bedding.

$$\begin{cases} v_h > \Leftrightarrow \dfrac{k_h}{k_v} > |\tan(\alpha)| \\ v_h < \Leftrightarrow \dfrac{k_h}{k_v} < |\tan(\alpha)| \end{cases} \tag{24}$$

Therefore, knowing $k_h$, $k_v$ and $\alpha$, it is possible to determine in which proportions the flow splits between the horizontal direction (i.e. within a plane parallel to the bedding plane) and the vertical one.

1. If $k_v=k_h$, at depth z, the flow is contained within a plane perpendicular to wellbore trajectory, the permeability is constant within the plane and the flow is axisymmetric within the plane: radial flow model can be used in such planes;
2. If $k_v \neq k_h$ and $k_h > k_v \tan(\alpha)$, the flow is mostly in the bedding plane intercepting the well trajectory at the considered depth z, the flow is axisymmetric within the plane since the permeability is isotropic ($k_x=k_y=k_h$) and assumed constant within the plane: radial flow model can be used in such planes; and
3. If $k_v \neq k_h$ and $k_h < k_v \tan(\alpha)$, the flow is mostly in the plane perpendicular to the bedding planes, intercepting the well trajectory at the considered depth z and, the flow is not axisymmetric within this plane: radial flow model cannot be used in such planes.

In the following, we describe a method to predict the flow around the wellbore when it is not axisymmetric. Examples of conditions giving rise to such flow include:

1. The flow is not in the bedding plane and at least one of the following conditions is true:
   a. $k_v$ is not equal to $k_h$
   b. the flow is confined: limited by an upper flow barrier and/or a lower flow barrier (such barriers are common features in geology and usually define the top and bottom of production zones)
2. The flow is in the bedding plane and the flow is confined due to the presence of a flow barrier in a plane perpendicular to the bedding plane (such barriers can be associated with impermeable fractures or faults in geology).

Before solving the flow, the wellbore trajectory is first discretized in multiple segments. For each segment, we defined a layer in the reservoir such that:

If criterion (24) says that the flow is mostly parallel to the bedding plane, the layer corresponding to the given segment is a slice formed by the plane parallel to the bedding plane intersecting the segment at its top (low value of z) and the plane parallel to the bedding plane intersecting the segment at its bottom (large value of z). The flow from the given wellbore segment into the reservoir will then be contained into the above slice If criterion (24) says that the flow is mostly perpendicular to the bedding plane, the layer corresponding to the given segment is a slice formed by the plane perpendicular to the bedding plane intersecting the segment at its top (low value of z) and the plane perpendicular to the bedding plane intersecting the segment at its bottom (large value of z). The flow from the given wellbore segment into the reservoir will then be contained into the above slice. The flow may be constrained by an upper and/or a lower impermeable flow barrier.

Figure 9A:
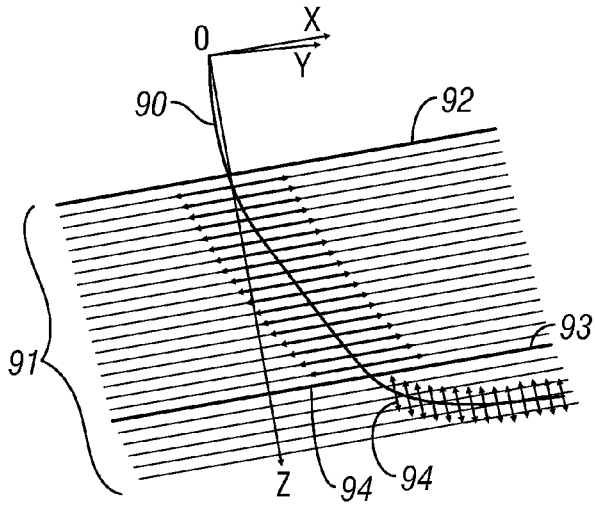
FIG. 9 is an example of a well segmentation and reservoir layering according to criterion (24). Horizontal flow in the upper part of the reservoir and vertical confined flow in the lower part of the reservoir.
Figure 9B:
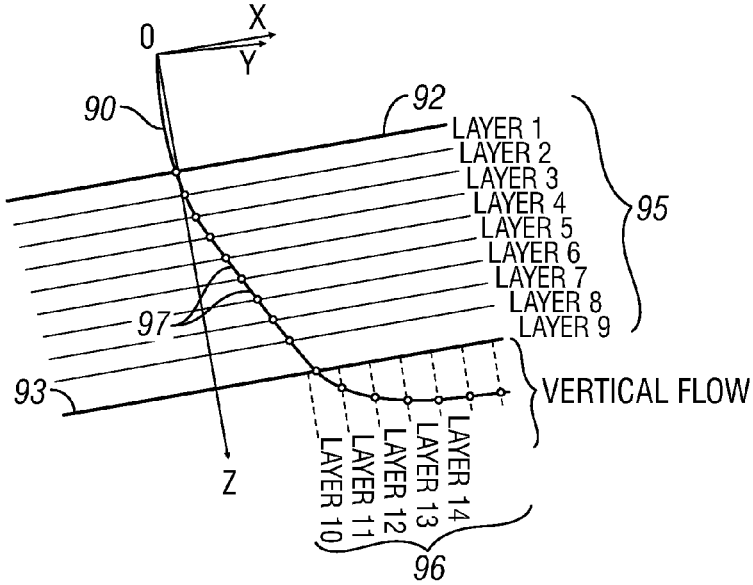

The above segmentation and layering is illustrated in FIG. 9. FIG. 9*a* shows a well bore trajectory [90] traversing a series of bedding planes [91] across impermeable barriers [92] and [93]. Flow lines [94] indicate horizontal or vertical flow. FIG. 9*b* shows regions of horizontal and vertical flow discretized into horizontal layers [95] and vertical layers [96] corresponding to wellbore segments [97].

The method for solving the flow between a wellbore segment and the corresponding reservoir layer is divided in several steps. In the following, we illustrate the method in condition 1a or 1b.

For a given segment-layer pair:

a) Define initial geometry of the domain in which the flow problem is to be solved
b) Determine the complex potential associated with the flow problem in the domain under consideration
c) Determine streamlines from the complex potential in the domain under consideration
d) Use streamlines to solve flow over a time step δt and propagate acid within the domain and update wormhole extent
e) Update definition of the domain according to wormhole extent
f) Update time
g) Go back to point b).

Figure 10:
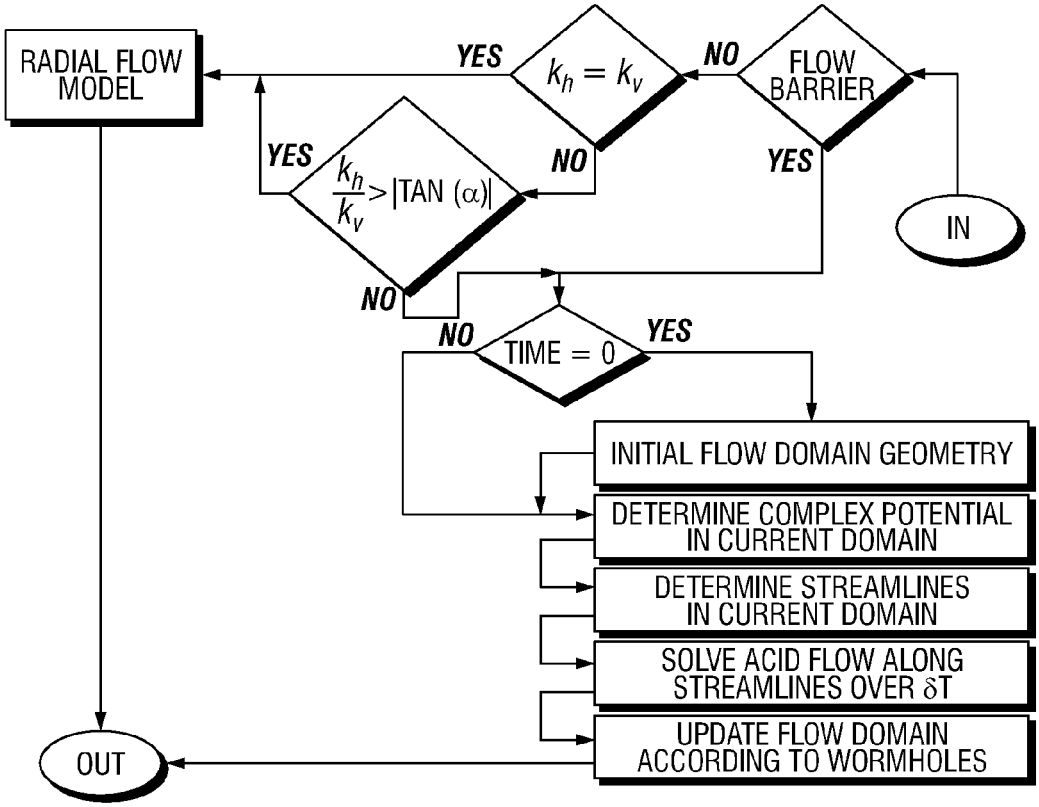
FIG. 10 is an example of workflow for solving flow around a wellbore segment in the corresponding reservoir layer.

According to criterion (24) and to the above, it is possible to derive a workflow for solving the flow of acid around the wellbore, in the reservoir layer corresponding to the wellbore segment under consideration. This workflow is illustrated in FIG. 10. In this workflow, a flow barrier is defined as any geological feature through which flow cannot occur, and which will change the trajectory of the streamlines when compared to the case where the barrier would have been absent. Such features include:

Impermeable layers

Impermeable faults, fractures and fissures

We assume that these features have an infinite extent in a given layer and, if more than one occurs in a given layer, they are parallel to each other.

Figure 11:
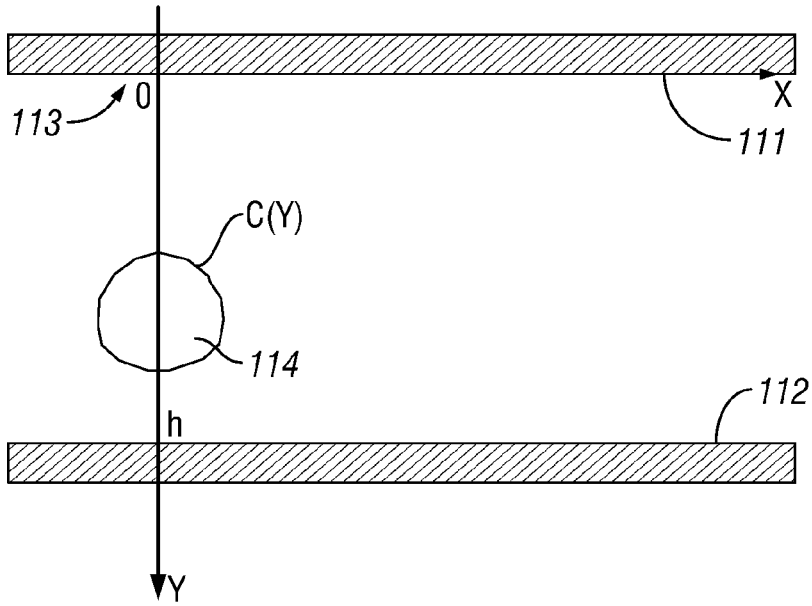
FIG. 11 is a flow domain in a layer perpendicular to the bedding plane.

Step a)—Define Initial Geometry:

In this case, the (x,y) plane is chosen to be perpendicular to the bedding plane and perpendicular to the plane formed by the wellbore trajectory. The problem consists of solving the flow of acid around the wellbore, in the considered reservoir. We assume the existence of an upper and lower flow barrier as described in FIG. 11.

The origin [113] of the y-axis is placed on the upper flow-barrier [111], we note h is the value of y at which the lower flow barrier [112] crosses the y-axis. We note (C(y),y) defines the contour of the wellbore [114] in the (x>0,y) semi-plane.

The initial flow field is determined by solving the following problem, resulting from Darcy's law and assuming incompressible single-phase flow:

$$\nabla\cdot(\mu\vec{V}) = \nabla\cdot\left(K\vec{\nabla}p\right) = k_x\frac{\partial^2 p}{\partial x^2} + k_y\frac{\partial^2 p}{\partial y^2} = 0 \tag{25}$$

$$\frac{\partial p}{\partial y}(x,0) = \frac{\partial p}{\partial y}(x,h) = 0$$

$$p(\pm C(y),\ y) = p_{wb}$$

$p_{wb}$, is the wellbore pressure in the wellbore segment under consideration, a function of time only in any segment. The x and y variable are rescaled as follows $$X = x,\ Y = y\sqrt{\frac{k_x}{k_y}} \tag{26}$$

Using the new rescaled variables, the problem becomes $$\begin{cases} \dfrac{\partial^2 p}{\partial X^2} + \dfrac{\partial^2 p}{\partial Y^2} = 0 \\ \dfrac{\partial p}{\partial Y}(X,0) = \dfrac{\partial p}{\partial Y}\left(X,\ H = h\sqrt{\dfrac{k_x}{k_y}}\right) = 0 \\ p\left(\pm C\left(Y\sqrt{\dfrac{k_y}{k_x}}\right),\ Y\right) = p_{wb} \end{cases} \tag{27}$$

Figure 12:
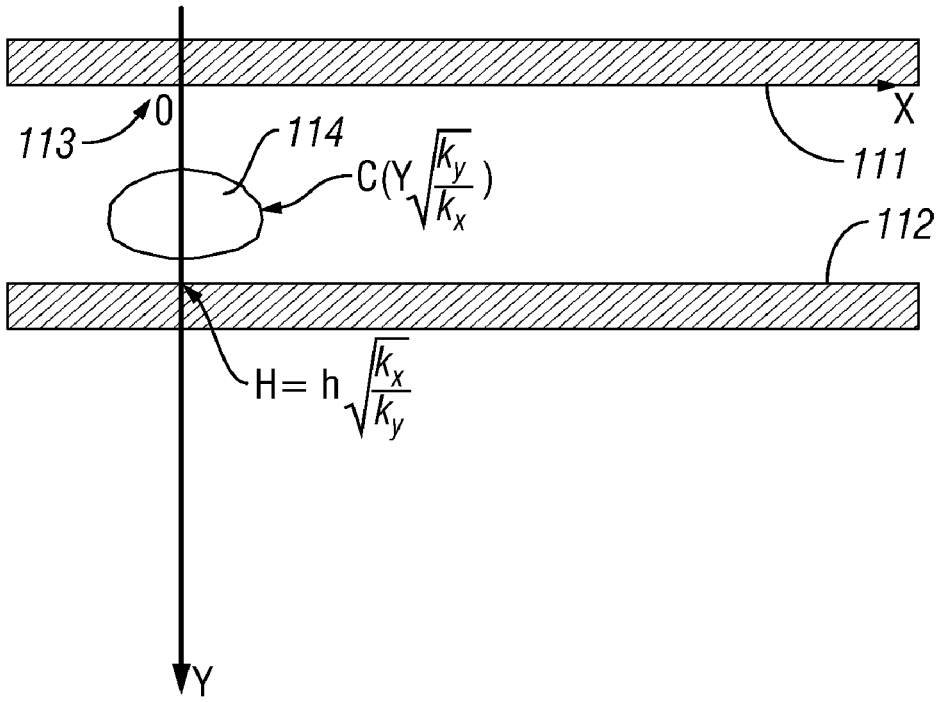
FIG. 12 is a flow domain after resealing.

The domain, in the new rescaled (X,Y) plan, is illustrated in FIG. 12.

Step b)—Determine the Complex Potential:

Problem (27) can be solved using the complex potential theory. We now illustrate one way to determine the complex potential associated to (27).

The complex potential for a source point located, in the complex plane, at $\zeta_s = X_s + iY_s$ is:

$$P(\zeta) = \ln(\zeta - \zeta_s) \tag{28}$$

Optionally, equation (28) contains a proportionality constant.

Figure 13:
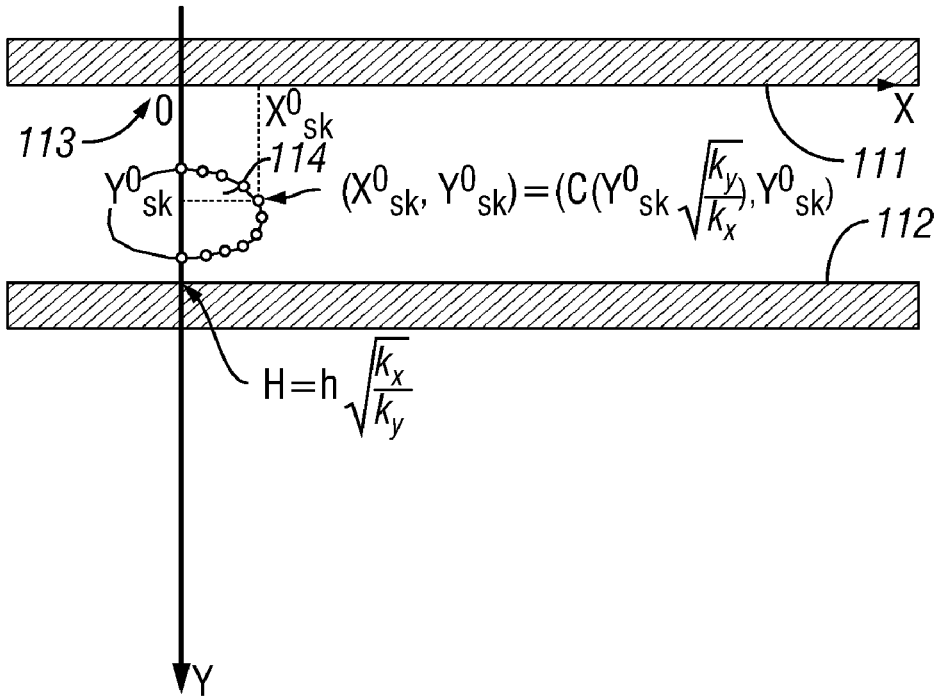
FIG. 13 shows a set of source points along the wellbore contour of the invention of disclosure.

Let $S^+$ be a set of source points evenly distributed along the contour C (see FIG. 13).

$$S^+ = \{\zeta_{s1}^{0+}, \ldots, \zeta_{sk}^{0+}, \ldots, \zeta_{sN}^{0+}\} \text{ where } \zeta_{sk}^{0+} = X_{sk}^0 + iY_{sk}^0 = C\left(Y_{sk}^0\sqrt{\frac{k_y}{k_x}}\right) + iY_{sk}^0 \tag{29}$$

Let $S^-$ be the set of points associated with the symmetric of C to the Y-axis:

$$S^- = \{\zeta_{s1}^{0-}, \ldots, \zeta_{sk}^{0-}, \ldots, \zeta_{sN}^{0-}\} \text{ where } \zeta_{sk}^{0-} = -X_{sk}^0 + iY_{sk}^0 = -C\left(Y_{sk}^0\sqrt{\frac{k_y}{k_x}}\right) + iY_{sk}^0 \tag{30}$$

The complex potential $\Pi_N^0$ associated with the set ($S^+$ U $S^-$) of source points is:

$$\Pi_N^0(\zeta) = \sum_{k=1,N} \left[\ln(\zeta - \zeta_{sk}^{0+}) + \ln(\zeta - \zeta_{sk}^{0-})\right] \tag{31}$$

The complex potential $\Pi^0$ associated with the union of C and its symmetric acting as a source line is $$\Pi^0(\zeta) = \lim_{N\to\infty} \Pi_N^0(\zeta). \tag{32}$$

At this stage, the domain in which the potential $\Pi^0$ is to be calculated is an unbounded plane (X,Y). In order to introduce the flow barriers located at Y=0 and Y=H, we introduce mirror images of $\Pi^0$ according to the Y=0 and Y=H axis. First, we note $\tilde{\Pi}^0$ the complex potential corresponding to the symmetric of C according to the Y=0 axis and build the following source point sets:

$$\tilde{S}^+ = \{\tilde{\zeta}_{s1}^{0+}, \ldots, \tilde{\zeta}_{sk}^{0+}, \ldots, \tilde{\zeta}_{sN}^{0+}\} \text{ where } \tilde{\zeta}_{sk}^{0+} = \tilde{X}_{sk}^0 - i\tilde{Y}_{sk}^0 = C\left(\tilde{Y}_{sk}^0\sqrt{\frac{k_y}{k_s}}\right) - i\tilde{Y}_{sk}^0 \tag{33}$$

$$\tilde{S}^- = \{\tilde{\zeta}_{s1}^{0-}, \ldots, \tilde{\zeta}_{sk}^{0-}, \ldots, \tilde{\zeta}_{sN}^{0-}\} \text{ where } \tilde{\zeta}_{sk}^{0-} = \tilde{X}_{sk}^0 - i\tilde{Y}_{sk}^0 = C\left(\tilde{Y}_{sk}^0\sqrt{\frac{k_y}{k_s}}\right) + i\tilde{Y}_{sk}^0 \tag{34}$$

We find the final complex potential Π:

$$\Pi(\zeta) = \sum_{j=-\infty}^{+\infty} \left[\Pi^j(\zeta) + \tilde{\Pi}^j(\zeta)\right] \tag{35}$$

$$\Pi^j(\zeta) = \lim_{N\to\infty} \Pi_N^j(\zeta) \quad \tilde{\Pi}^j(\zeta) = \lim_{N\to\infty} \tilde{\Pi}_N^j(\zeta) \tag{36}$$

$$\Pi_N^j(\zeta) = \sum_{k=1,N} [\ln(\zeta - \zeta_{sk}^{j+}) + \ln(\zeta - \zeta_{sk}^{j-})] \quad \tilde{\Pi}_N^j(\zeta) = \sum_{k=1,N} \left[\ln\left(\zeta - \tilde{\zeta}_{sk}^{j+}\right) + \ln\left(\zeta - \tilde{\zeta}_{sk}^{j-}\right)\right] \tag{37}$$

$$\zeta_{sk}^{j\pm} = \pm X_{sk}^j + iY_{sk}^j = \pm C\left(Y_{sk}^0\sqrt{\frac{k_y}{k_x}}\right) + iY_{sk}^j \quad Y_{sk}^j = 2jH + Y_{sk}^0 \tag{38}$$

$$\tilde{\zeta}_{sk}^{j\pm} = \pm \tilde{X}_{sk}^j + i\tilde{Y}_{sk}^j = \pm C\left(Y_{sk}^0\sqrt{\frac{k_y}{k_x}}\right) + i\tilde{Y}_{sk}^j \quad \tilde{Y}_{sk}^j = 2jH - Y_{sk}^0 \tag{39}$$

By definition, the components $V_X$ and $V_Y$ of the flow velocity vector $\vec{V}$ in the (X,Y) plane are:

$$V_X(\zeta) = \mathrm{Re}\left[\frac{\partial\Pi}{\partial\zeta}(\zeta)\right] \quad V_Y(\zeta) = -\mathrm{Im}\left[\frac{\partial\Pi}{\partial\zeta}(\zeta)\right] \tag{40}$$

By calculating the complex derivatives of the complex potential Π, one finds:

$$V_X(\zeta) = \sum_{j=-\infty}^{+\infty} V_X^+(\zeta) + V_X^-(\zeta) \tag{41}$$

$$V_X^+(\zeta) = \lim_{N\to\infty}\left[\sum_{k=1}^{N}\left(\frac{X - X_{sk}^j}{(X - X_{sk}^j)^2 + (Y - Y_{sk}^j)^2} + \frac{X - \tilde{X}_{sk}^j}{(X - \tilde{X}_{sk}^j)^2 + (Y - \tilde{Y}_{sk}^j)^2}\right)\right]$$

$$V_X^-(\zeta) = \lim_{N\to\infty}\left[\sum_{k=1}^{N}\left(\frac{X + X_{sk}^j}{(X + X_{sk}^j)^2 + (Y - Y_{sk}^j)^2} + \frac{X + \tilde{X}_{sk}^j}{(X + \tilde{X}_{sk}^j)^2 + (Y - \tilde{Y}_{sk}^j)^2}\right)\right]$$

and

-continued $$V_Y(\zeta) = \sum_{j=-\infty}^{+\infty} V_Y^+(\zeta) + V_Y^-(\zeta) \tag{42}$$

$$V_Y^+(\zeta) = \lim_{N\to\infty}\left[\sum_{k=1}^{N}\left(\frac{Y - Y_{sk}^j}{(X - X_{sk}^j)^2 + (Y - Y_{sk}^j)^2} + \frac{Y - \tilde{Y}_{sk}^j}{(X - \tilde{X}_{sk}^j)^2 - (Y - \tilde{Y}_{sk}^j)^2}\right)\right]$$

$$V_Y^-(\zeta) = \lim_{N\to\infty}\left[\sum_{k=1}^{N}\left(\frac{Y - Y_{sk}^j}{(X + X_{sk}^j)^2 + (Y - Y_{sk}^j)^2} + \frac{Y - \tilde{Y}_{sk}^j}{(X + \tilde{X}_{sk}^j)^2 + (Y - \tilde{Y}_{sk}^j)^2}\right)\right]$$

Step c)—Determine Streamlines from the Complex Potential:

For any pair of coordinates (X,Y), one can compute the velocity vector in the (X,Y) plane using Equations (41) and (42). From the knowledge of the velocity vector at any point, streamlines can be computed solving the streamline equation:

$$V_X\delta Y = V_Y\delta X \tag{43}$$

For building the streamlines, one method consists of choosing a small value for a displacement step δ along the streamline. The origin of a given streamline is a point (X,Y) on the wellbore contour. Then there are 2 cases:

If $V_X$ is larger than $V_Y$ in absolute value, then we take δX=δ and, knowing $V_X$ and $V_Y$ at (X,Y), the displacement (δX,δY) along the streamline can be computed by calculating δY from Equation (43), and a new point is determined on the streamline: (X+δX,Y+δY)

If $V_Y$ is larger than $V_X$ in absolute value, then we take δY=δ and, knowing $V_X$ and $V_Y$ at (X,Y), the displacement (δX,δY) along the streamline can be computed by calculating δX from Equation (43)), and a new point is determined on the streamline: (X+δX,Y+δY)

Figure 14A:
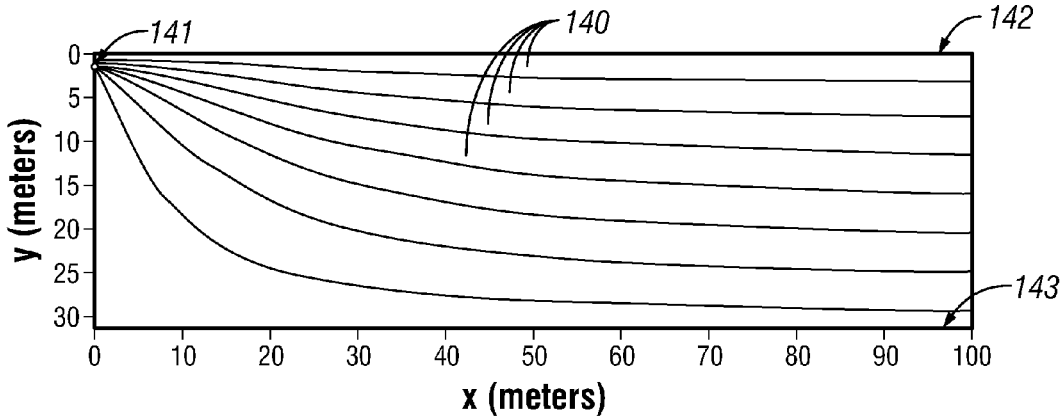
FIG. 14*a* shows a set of streamlines [140] computed with a permeability ratio $k_h/k_v=5$. The wellbore is located at 1.4 m from the top (y=0) impermeable barrier [142]. Another impermeable barrier [143] is located at the bottom y=h=31.8 m.
Figure 14B:
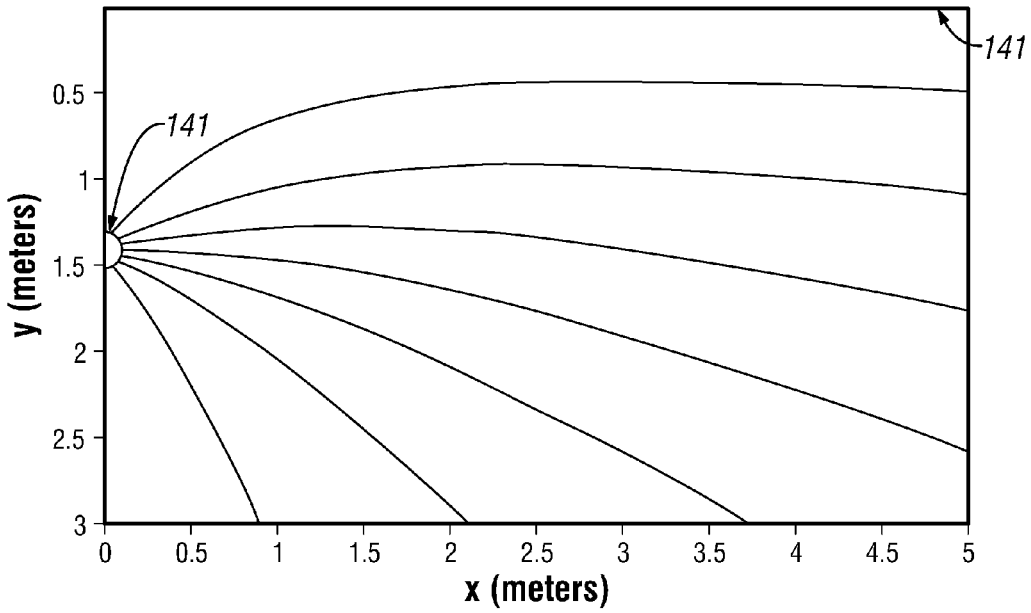
FIG. 14*b* is a zoom of FIG. 14*a* around the wellbore.
Figure 15A:
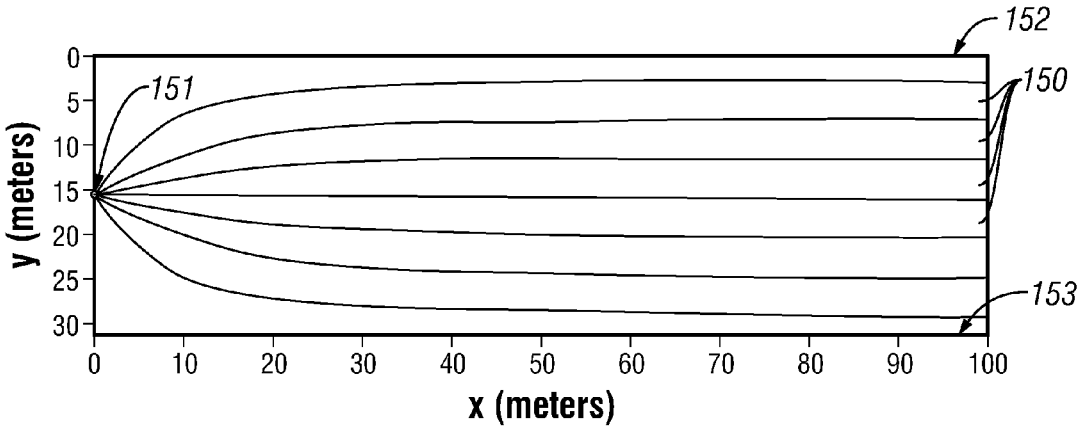
FIG. 15*a* shows a set of streamlines [150] computed with a permeability ratio $k_h/k_v=5$. The wellbore [151] is located at 15.75 m from the top (y=0) impermeable barrier [152]. Another impermeable barrier [153] is located at the bottom y=h=31.8 m.
Figure 15B:
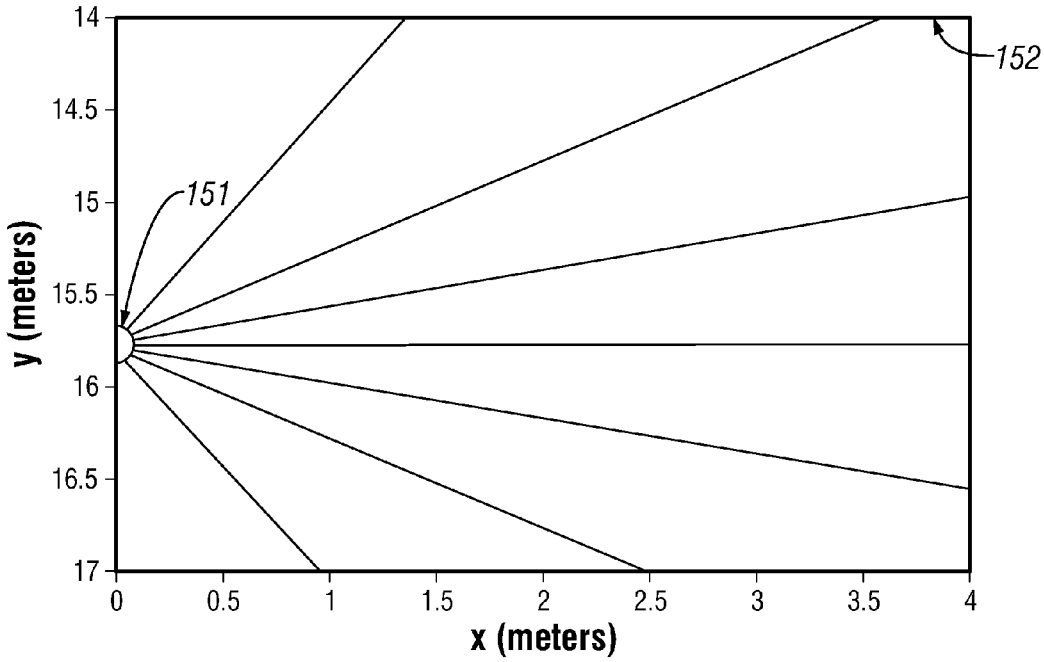
FIG. 15*b* is a zoom of FIG. 15*a* around the wellbore.

By iterating the above, any streamline originating from a point on the wellbore contour can be drawn. The streamlines in the original (x,y) plane can be obtained from the streamlines in the (X,Y) plane by re-scaling the coordinates using Equation (26). FIGS. 14 and 15 illustrate streamlines computed using the above method. FIG. 14*a* shows a set of streamlines [140] computed with a permeability ratio $k_h/k_v$=5. The wellbore is located at 1.4 m from the top (y=0) impermeable barrier [142]. Another impermeable barrier [143] is located at the bottom y=h=31.8 m. FIG. 14*b* is a zoom of FIG. 14*a* around the wellbore. FIG. 15*a* shows a set of streamlines [150] computed with a permeability ratio $k_h/k_v$=5. The wellbore [151] is located at 15.75 m from the top (y=0) impermeable barrier [152]. Another impermeable barrier [153] is located at the bottom y=h=31.8 m. FIG. 15*b* is a zoom of FIG. 15*a* around the wellbore.

Step d)—Use Streamlines to Solve Flow

Once the streamlines are computed, acid flow is solved along the streamlines. In the following, we develop a method based on the finite-volume technique to solve flow along streamlines.

The Darcy velocity at any point and time in the (x,y) plane can be obtained from Darcy's law:

$$\begin{cases} \vec{V}(x, y) = -KM(x, y)\vec{\nabla} p(x, y) \\ K = \begin{pmatrix} k_x & 0 \\ 0 & k_y \end{pmatrix} \end{cases} \tag{44}$$

Figure 16:
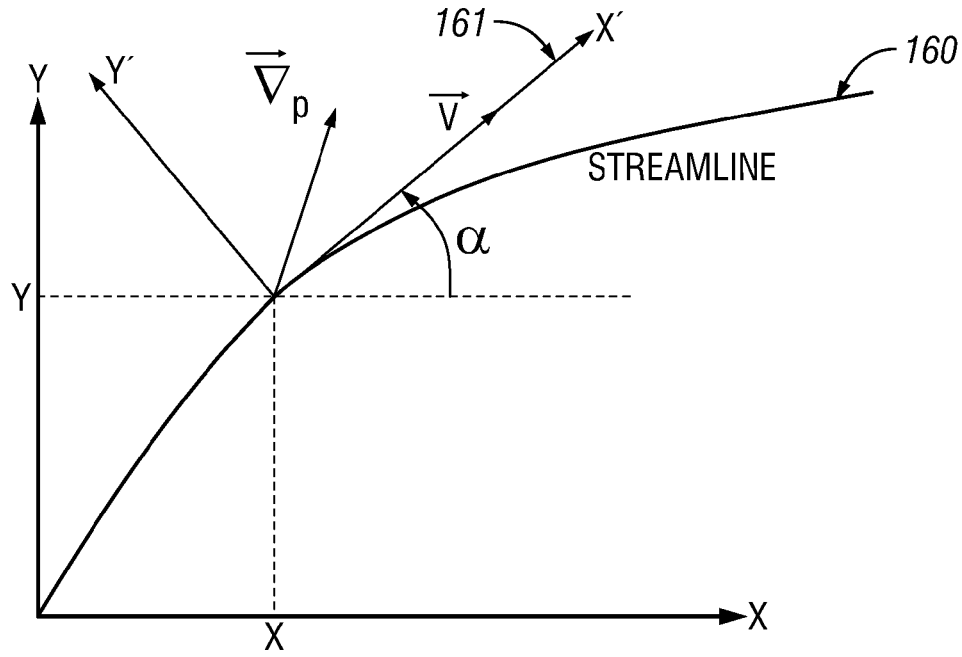
FIG. 16 shows a streamline with velocity and pressure gradient at a point (x,y)

M is the fluid mobility. We now develop a finite-volume approach to solve (44). Referring to FIG. 16, consider the streamline [160] passing through point (x,y) and $\vec{V}$ the Darcy velocity at this point. We note (x',y') defines the coordinate system [161] where the x'-axis is in the direction of $\vec{V}$, as illustrated in FIG. 16. In this coordinate system, we have the following relationships:

$$\begin{cases} \vec{V} = \begin{pmatrix} \|\vec{V}\| \\ 0 \end{pmatrix}_{(x',y')} = \begin{pmatrix} \sqrt{u^2 + v^2} \\ 0 \end{pmatrix}_{(x',y')} \\ \vec{\nabla} p = \begin{pmatrix} \frac{\partial p}{\partial x'} \\ \frac{\partial p}{\partial y'} \end{pmatrix}_{(x',y')} - \frac{1}{M}\frac{1}{\|\vec{V}\|}\begin{pmatrix} \frac{u^2}{k_x} + \frac{v^2}{k_y} \\ \frac{uv}{k_x} - \frac{uv}{k_y} \end{pmatrix}_{(x',y')} \end{cases} \tag{45}$$

Therefore, the velocity along the streamline [160] can be determined from the knowledge of the pressure gradient along the streamline using the effective permeability along the streamline noted k':

$$\begin{cases} \vec{V}\begin{pmatrix} \|\vec{V}\| \\ 0 \end{pmatrix}_{(x',y')} = \begin{pmatrix} -k' M_{(x',y')} \frac{\partial p}{\partial x'} \\ 0 \end{pmatrix}_{(x',y')} \\ k' = \frac{1}{\frac{\cos^2(\alpha)}{k_x} + \frac{\sin^2(\alpha)}{k_y}} \end{cases} \tag{46}$$

The angle $\alpha$ can be determined when the streamline is computed using Equation (43):

$$\begin{cases} \cos(\alpha) = \frac{\delta x}{\sqrt{(\delta x)^2 + (\delta y)^2}} \\ \sin(\alpha) = \frac{\delta y}{\sqrt{(\delta x)^2 + (\delta y)^2}} \end{cases} \text{ and } \delta y = \delta Y\sqrt{\frac{k_x}{k_y}} \text{ and } \delta x = \delta X \tag{47}$$

One can now compute the flow velocity along the streamline from the component of the pressure gradient along the streamline and from the effective permeability along the streamline using Equation (46). In order to compute the pressure distribution along each streamline, we first consider a set $S_k$ of points along the streamline identified by the index k, denoted $St_k$, originating from the following point. This set of points will be used to discretize the streamline in order to apply a finite-volume method to solve the flow along them:

$$s_{k,0} = (x_{sk}^0, y_{sk}^0) = (C(y_{sk}^0), y_{sk}^0) \tag{48}$$

and

-continued $$\begin{aligned} S_k &= \{s_{k,0}, s_{k,1}, \ldots, s_{k,m}\} \\ s_{k,i} &= (x_{k,i}, y_{k,i}) \\ (x_{k,0}, y_{k,0}) &= (x_{sk}^0, y_{sk}^0) \end{aligned} \tag{49}$$

Let $\bar{s}$ be the curvilinear distance along the streamline $St_k$ with origin $s_{k,0}$. The points along streamline $St_k$ can be identified through their streamline coordinate. The definition of $S_k$ in (49) is equivalent to (50):

$$\begin{aligned} S_k &= \{\bar{s}_{k,0}, \bar{s}_{k,1}, \ldots, \bar{s}_{k,m}\} \\ \bar{s}_{k,0} &= 0 \end{aligned} \tag{50}$$

For each pair $(\bar{s}_{k,i}, \bar{s}_{k,i+1})$ of point along streamline $St_k$, we defined an interface point $\bar{s}_{k,i+1/2}$ on the streamline such that $$\bar{s}_{k,i+1/2} \in ]\bar{s}_{k,i}, \bar{s}_{k,i+1}[ \tag{51}$$

For instance, one can choose the mid-distance between $\bar{s}_{k,i}$ and $\bar{s}_{k,i+1}$:

$$\bar{s}_{k,i+1/2} = \frac{1}{2}(\bar{s}_{k,i} + \bar{s}_{k,i+1}) \tag{52}$$

Additionally, we consider the streamlines $St_{k+1/2}$ originating from points denoted $$(x_{sk+1/2}{}^0, y_{sk+1/2}{}^0) = (C(y_{sk+1/2}{}^0), y_{sk+1/2}{}^0) \tag{53}$$

such that $$y_{sk+1/2}{}^0 = ]y_{sk}{}^0, y_{sk+1}{}^0[ \tag{54}$$

We can now define a control volume [170] (see FIGS. 17*a* and 17*b*) around a point $\bar{s}_{k,i}$ on streamline $St_k$, as one would do in order to apply the finite-volume technique. We consider the curve $E_{k,i+1/2}$ intersecting $St_k$ at $\bar{s}_{k,i+1/2}$ and intersecting all other possible streamlines located between $St_{k-1/2}$ and $St_{k+1/2}$ at a right-angle in the re-scaled (X,Y) plan. Such lines are known as equipotential curves and can be determined by solving the following equation $$V_Y \delta Y = -V_X \delta X \tag{55}$$

Figure 17A:
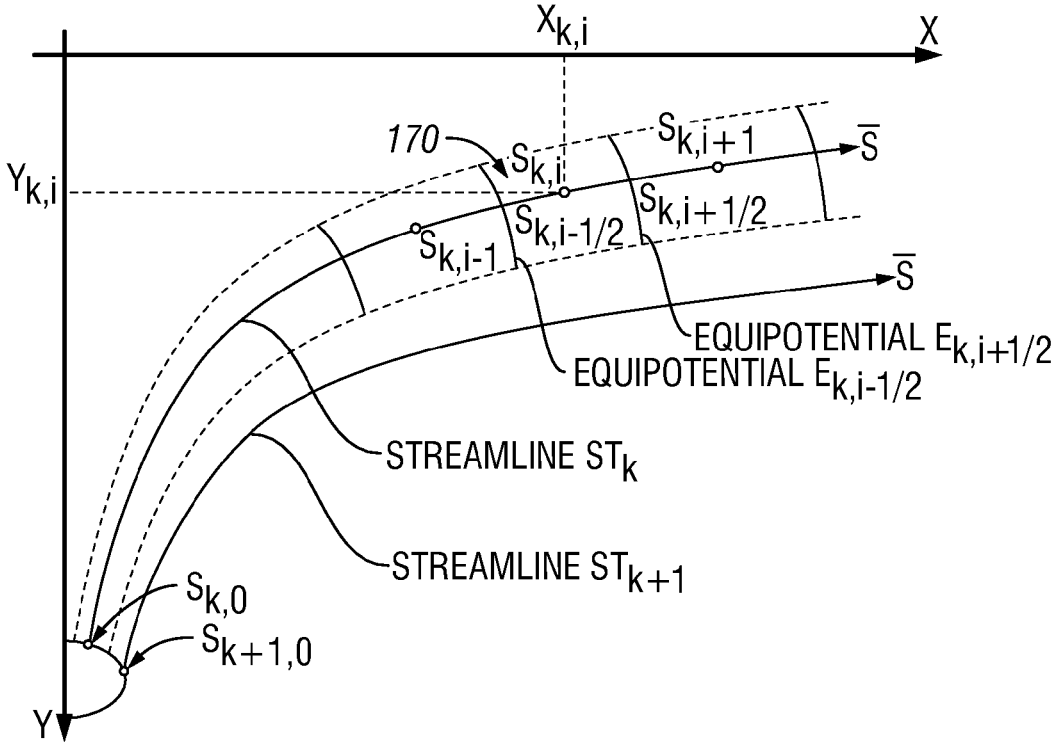
FIGS. 17*a* and 17*b* are graphs showing a control volume [170] around a point $\bar{s}_{k,i}$ on the streamline $St_k$ for finite volume calculations.
Figure 17B:
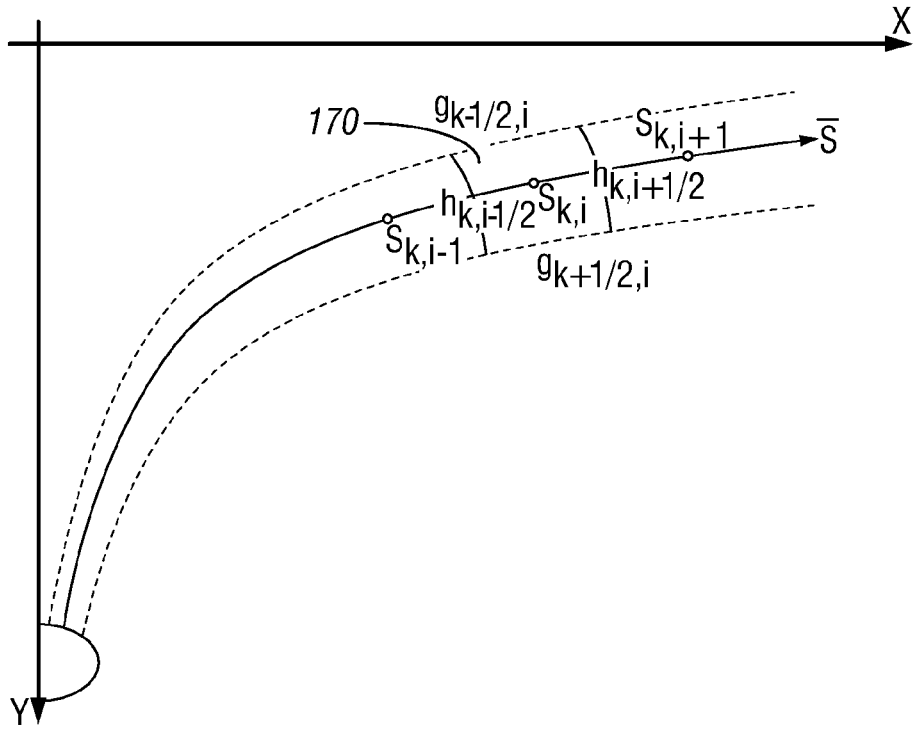

We now consider the connex domain $\Omega_{k,i}$ formed by the intersection of $St_{k-1/2}$ and $St_{k+1/2}$ and $E_{k,i+1/2}$ and $E_{k,i-1/2}$. (In a connex set any two points in the set may be connected by a line that is made up of points that are all entirely within the set.) The boundary $\Gamma_{k,i}$ of this volume is the union of four segments, as illustrated in FIGS. 17*a* and 17*b:*

$$\Gamma_{k,i} = h_{k,i-1/2} \cup h_{k,i+1/2} \cup g_{k-1/2,i} \cup g_{k+1/2,i} \tag{56}$$

$g_{k-1/2,i}$ and $g_{k+1/2,l}$ are formed by the segments along $St_{k-1/2}$ and $St_{k+1/2}$ respectively, between $E_{k,i+1/2}$ and $E_{k,i-1/2}$. By the definition of streamlines, no fluid flows across $g_{k-1/2,i}$ and $g_{k+1/2,i}$ and therefore, the volumetric rate $Q_{k,i-1/2}$ per unit thickness along z, across $h_{k,i-1/2}$ equals that across $h_{k,i+1/2}$:

$$Q_{k,i+1/2} = Q_{k,i-1/2} = Q_k \tag{57}$$

If the flow occurs in a region where the fluids are compressible then, the mass rate $Q^m$ per unit thickness along z, across $h_{k,i-1/2}$ is linked to that across $h_{k,i+1/2}$ as follows:

$$\delta t(Q_{k,i-1/2}{}^m(t) - Q_{k,i+1/2}{}^m(t)) = (m_{k,i}(t+\delta t) - m_{k,i}(t)) \tag{58}$$

$m_{k,i}$ is the mass of fluid per unit thickness along z contained in $\Omega_{k,i}$.

We now consider 2 cases:

1. The fluid flowing within $\Omega_{k,i}$ is incompressible
2. The fluid flowing within $\Omega_{k,i}$ is compressible Case 1: In this case, we have $$Q_{k,i+1/2}=Q_{k,i-1/2}=Q_k \tag{57}$$

By integration of Darcy's law:

$$Q_{k,i+1/2} = -(p_{k,i+1} - p_{k,i})T_{k,i+1/2} \tag{59}$$

$$T_{k,i+1/2} = \frac{1}{\int_{s_{k,i}}^{s_{k,i+1}} \frac{1}{\bar{h}(\bar{s})k'(\bar{s})M(\bar{s})} d\bar{s}}$$

k' is defined in (46). $\bar{h}(\bar{s})$ is the curvilinear length of the segment along the equipotential intersecting $St_k$ at a distance $\bar{s}$ from $s_{k,0}$ and contained within $\Omega_{k,i}$. In the limit of a large number of streamlines, one can estimate $\bar{h}(\bar{s})$ as follows:

$$\bar{h}(\bar{s}) = \frac{\|\vec{V}\|(0)}{\|\vec{V}\|(\bar{s})}\bar{h}(0) \tag{60}$$

$$\frac{\|\vec{V}\|(0)}{\|\vec{V}\|(\bar{s})}$$

can be easily determined from (41) and (42), and $\bar{h}(0)$ is given by the set $S_k$ of the streamline origins:

$$S_k = \{s_{k,0}, s_{k,1}, \ldots, s_{k,m}\} \tag{49}$$

$$s_{k,i} = (x_{k,i}, y_{k,i})$$

$$(x_{k,0}, y_{k,0}) = (x_{sk}^0, y_{sk}^0)$$

$\bar{h}(0)$ can be approximated as follows:

$$\bar{h}_k(0) \approx \frac{1}{2}\left[\sqrt{(x_{k+1,0} - x_{k,0})^2 + (y_{k+1,0} - y_{k,0})^2} + \sqrt{(x_{k-1,0} - x_{k,0})^2 + (y_{k-1,0} - y_{k,0})^2}\right] \tag{61}$$

$T_{k,i+1/2}$ may be approximated as follows $$T_{k,i+1/2}^{-1} \approx \frac{1}{k'(\bar{s}_{k,i+1/2})h(\bar{s}_{k,i+1/2})M_{k,i+1/2}}(\bar{s}_{k,i+1} - \bar{s}_{k,i}) \tag{62}$$

$$M_{k,i+1/2} = \begin{cases} M(\bar{s}_{k,i}) \text{ if } (p_{k,i+1} - p_{k,i}) < 0 \\ M(\bar{s}_{k,i+1}) \text{ if } (p_{k,i+1} - p_{k,i}) > 0 \end{cases}$$

Case 2: In this case, we have $$\delta t(Q_{k,i-1/2}^m(t) - Q_{k,i+1/2}^m(t)) = (m_{k,i}(t + \delta t) - m_{k,i}(t)) \tag{63}$$

$$Q_{k,i+1/2}^m = -(p_{k,i+1} - p_{k,i})T_{k,i+1/2}^m \tag{64}$$

$$T_{k,i+1/2}^m = \frac{1}{\int_{s_{k,i}}^{s_{k,i+1}} \frac{1}{\rho(p(\bar{s}))\bar{h}(\bar{s})k'(\bar{s})M(\bar{s})} d\bar{s}}$$

k' is defined in (46). $\bar{h}(\bar{s})$ is the curvilinear length of the segment along the equipotential intersecting $St_k$ at a distance $\bar{s}$ from $s_{k,0}$ and contained within $\Omega_{k,i}$. ρ is the density of the fluid, assumed to be a function of the pressure p.

$T_{k,i+1/2}{}^m$ may be approximated as follows:

$$(T_{k,i+1/2}^m)^{-1} \approx \frac{1}{k'(\bar{s}_{k,i+1/2})h(\bar{s}_{k,i+1/2})\rho_{k,i+1/2}M_{k,i+1/2}}(\bar{s}_{k,i+1} - \bar{s}_{k,i}) \tag{65}$$

$$M_{k,i+1/2} = \begin{cases} M(\bar{s}_{k,i}) \text{ if } (p_{k,i+1} - p_{k,i}) < 0 \\ M(\bar{s}_{k,i+1}) \text{ if } (p_{k,i+1} - p_{k,i}) > 0 \end{cases}$$

$$\rho_{k,i+1/2} = \begin{cases} \rho(\bar{s}_{k,i}) \text{ if } (p_{k,i+1} - p_{k,i}) < 0 \\ \rho(\bar{s}_{k,i+1}) \text{ if } (p_{k,i+1} - p_{k,i}) > 0 \end{cases}$$

Cases 1 & 2:

The mobility $M(\bar{s}_{k,i})$ can be determined by solving mass transport along the streamline $St_k$. Mass transport may consist either of the two following approaches:

1. Mass conservation equation of the different species and fluids under consideration. These equations allow the determination of the concentrations and saturations of the different species and fluids, respectively, at any time along a given streamline. From the distribution of the concentrations and saturations, the average fluid mobility can be computed.
2. Front tracking of various mobility fronts. As fluids flow along the streamlines, a range of mobility values propagates along the streamlines. Between two fronts, each associated with a different value of the fluid mobility, the fluid mobility is approximated as being constant.

We illustrate method 2 in the following.

It is common knowledge in the industry that, as acid flows within a carbonate rock, wormholes propagate. It has been found by some authors that the velocity at which wormholes propagate is a function of the flow velocity around the wormhole. Therefore, some authors have proposed the following algorithm to track the tip of the wormholes with time.

$$\frac{\partial \vec{T}_w}{\partial t}(t) = \frac{1}{\varphi_0}\frac{\vec{V}_D(t, x_w, y_w)}{\theta_0(\vec{V}_D(t, x_w, y_w))} \tag{66}$$

$\vec{T}_w=(x_w,y_w)$ is the position vector tracking the front formed by the tip of the wormholes. $\phi_0$ is the initial porosity of the rock. $\theta_0(\vec{V}_D(t,x_w,y_w))$ is known as the pore-volume to breakthrough and a function of the velocity. The disclosure above describes how $\theta_0$ can be measured from linear core-flood experiments. The inverse of $\theta_0$ is, by definition, the relative velocity at which the tip of the wormholes propagate, i.e. relative to the mean Darcy velocity Q/A.

Two forms of (66) have been proposed in the literature. For linear flow fields, as observed during core-flooding experiments for instance, (66) can be re-written as follows:

$$\frac{\partial x_w}{\partial t}(t, x, y) = \frac{1}{\varphi_0}\frac{u(t)}{\theta_0(u)} = \frac{1}{\varphi_0}\frac{Q(t)}{A\theta_0\left(\frac{Q}{A}\right)} \tag{67}$$

where $x_w$ is the distance traveled by the tip of the wormholes in the flow direction (assumed to be the x-axis direction in this case), u is the x-component of the Darcy velocity $\vec{V}_D$, Q the flow-rate and A the cross-section area in the plane orthogonal to the x-axis. For radial flow, some authors have proposed the following:

$$\frac{\partial r_w}{\partial t}(t, x, y) = \frac{1}{\varphi_0}\frac{u_r(t, r_w)}{\theta_0(u_r(t, r_w))} = \frac{1}{\varphi_0}\frac{Q(t)}{2\pi\delta z r_w\theta_0(u_r(t, r_w))} \tag{68}$$

where $r_w$ is the radial distance traveled by the front formed by the tip of the wormholes and δz is the thickness of the flow domain in the direction orthogonal to the radial plane.

Besides, it is commonly admitted that the mobility of the fluid, upstream of the front tracking the wormhole tips, is constant. In this region, the fluid mobility is high due to an increase of the permeability generated by the wormholes. If we note μ the viscosity of the acid, $b_k$ is permeability increase in the wormhole region, then, the fluid mobility upstream of the wormhole tip front is:

$$M = M_w = \frac{k_0}{\mu_d\frac{\Delta p_{bt}}{\Delta p_0}} \tag{69}$$

This value of the fluid mobility can be applied in the interval $[\bar{s}_{k,0},\bar{s}_{k,w}]$ along the streamline $St_k$, where $\bar{s}_{k,w}$ is the curvilinear distance traveled by the front formed by the tips of the wormholes along Stk. We propose an extension of (67) and (49) to arbitrary flow fields along a streamline:

$$\frac{\partial \bar{s}_{k,w}}{\partial t}(t) = \frac{1}{\varphi_0}\frac{Q_{k,w}(t)}{\bar{h}(\bar{s}_{k,w}(t))\theta_0(u_{k,w}(t))} \tag{70}$$

$$u_{k,w}(t) = \frac{Q_{k,w}(t)}{\bar{h}(\bar{s}_{k,w}(t))}$$

where $Q_{k,w}(t)$ is the volumetric flow rate per unit thickness along the z-axis on streamline $St_k$, at a distance $\bar{s}_{k,w}$ from its origin. $Q_{k,w}$ may be determined by either solving (57) if the flow is that of an incompressible fluid, or (63) otherwise. $\bar{h}(\bar{s}_{k,w})$ may be determined used Equation (60).

Similarly, as various mobility fronts develop along the streamlines, other variable may be introduced to track the curvilinear distance traveled by such fronts. As described above, another zone of constant mobility has been introduced for Self-Diverting acids, propagating ahead to the wormhole tips. Equation (13) is used for predicting the mobility $M_r$ in this zone; this equation is reproduced in part in Equation (72). Also, as shown above, the relative velocity at which this front propagates is shown to be the inverse of $\theta_r$, a quantity which can be assessed from linear core-flood experiments (see equation (2).

To solve the general flow problem of a self-diverting acid in non-axisymmetric flow about the borehole, we therefore define a new variable $\bar{s}_{k,r}$ measuring the distance traveled on $St_k$ by the zone in which the fluid mobility is equal to $M_r$ and, such that, $$\frac{\partial \bar{s}_{k,r}}{\partial t}(t) = \frac{1}{\varphi_0}\frac{Q_{k,r}(t)}{\bar{h}(\bar{s}_{k,r}(t))\theta_r(u_{k,r}(t))} \tag{71}$$

$$u_{k,r}(t) = \frac{Q_{k,r}(t)}{\bar{h}(\bar{s}_{k,r}(t))} \tag{72}$$

$$M = M_r = \frac{k_0}{\mu_d\frac{\Delta p_r}{\Delta p_0}\frac{\theta_0}{\theta_0 - \theta_r}}$$

$Q_{k,r}(t)$ is the volumetric flow rate per unit thickness along the z-axis on streamline $St_k$, at a distance $\bar{s}_{k,r}$ from its origin. $Q_{k,r}$ may be determined by either solving (57) if the flow is that of an incompressible fluid, or (63) otherwise.

In various embodiments, the method detailed above is carried out in as many mobility zones as are of interest to the user.

Steps e), f), and g)—Update Parameters and Iterate

Figure 18:
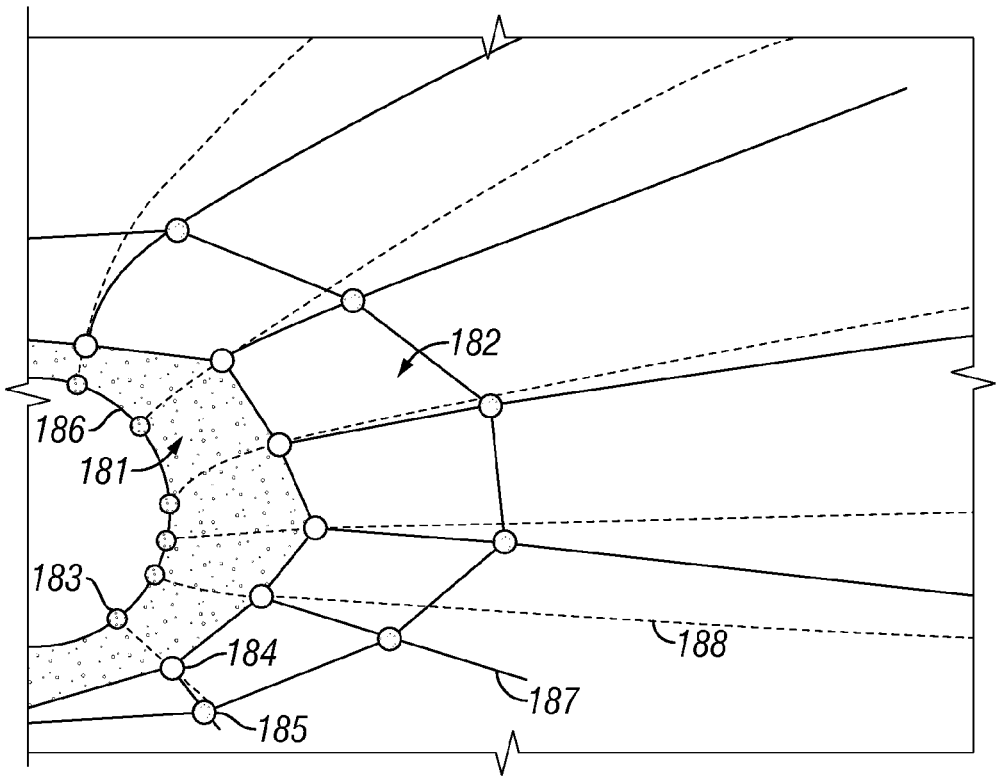
FIG. 18 illustrates updating of the streamlines after each time step. [181]: extent of the wormholed zone after first time step. [182]: extent of the wormholed zone after second time step.

Once the various fronts under interest have been propagated over a time step δt, the flow domain can be updated. Because the wormholes change the permeability in the zone through which they have propagated, the flow field at the next time-step may be different. Therefore, the streamlines will have moved and a new set of streamlines must be determined. In the following, we present a method for doing so:

Since the permeability generated by the wormholes is several orders of magnitude larger than the original permeability of the rock, one can consider that the pressure drops between the wellbore and the tip of the wormholes are negligible. Consequently, the contour of the zone defined the region around the wellbore through which the wormholes have propagated can be used as in Step b) to distribute the source points which will serve as streamline origins. For convenience, these source points can be taken as the point defined by the $\bar{s}_{k,tip}$. Then Step b) can be reiterated to generate the new streamlines for the next time step. This algorithm is illustrated in FIG. 18. (FIG. 18 illustrates updating of the streamlines after each time step. [181]: extent of the wormholed zone after first time step. [182]: extent of the wormholed zone after second time step.) Points [183] are the initial source points used as streamlines origins along the wellbore contour [186]. Points [184] represent the position of the wormhole tips after the first time step; these serve as source points to re-calculate the streamlines after the first time step. Points [185] represent the position of the wormhole tips after the second time step; they serve as source points to re-calculate the streamlines after the second time step, and so on. Dotted lines [188] illustrate the initial streamlines; solid lines [187] illustrate new streamlines after the first time step.

Because the ultimate goal of matrix acidizing is to alter fluid flow in a reservoir, reservoir engineering must provide the goals for a design. In addition, reservoir variables may impact the treatment performance.

In various embodiments, the overall procedure is implemented into an acid placement simulator to predict the fate of a given design in the field. The simulator includes input means for input of reservoir parameters, formation parameters, acid formulations, results of core flood experiments, and the like; a processor unit connected to the input means and programmed with software instructions that carry out the steps outlined above, including the use of the complex potential to determine streamlines used to solve for the flow in the geologic formation, and output means communicating with the for reporting the results of the simulations. The results include treatment levels and rates for a given acid formulation in a given geological formation to enhance production of oil or gas from the formation.

Figure 19:
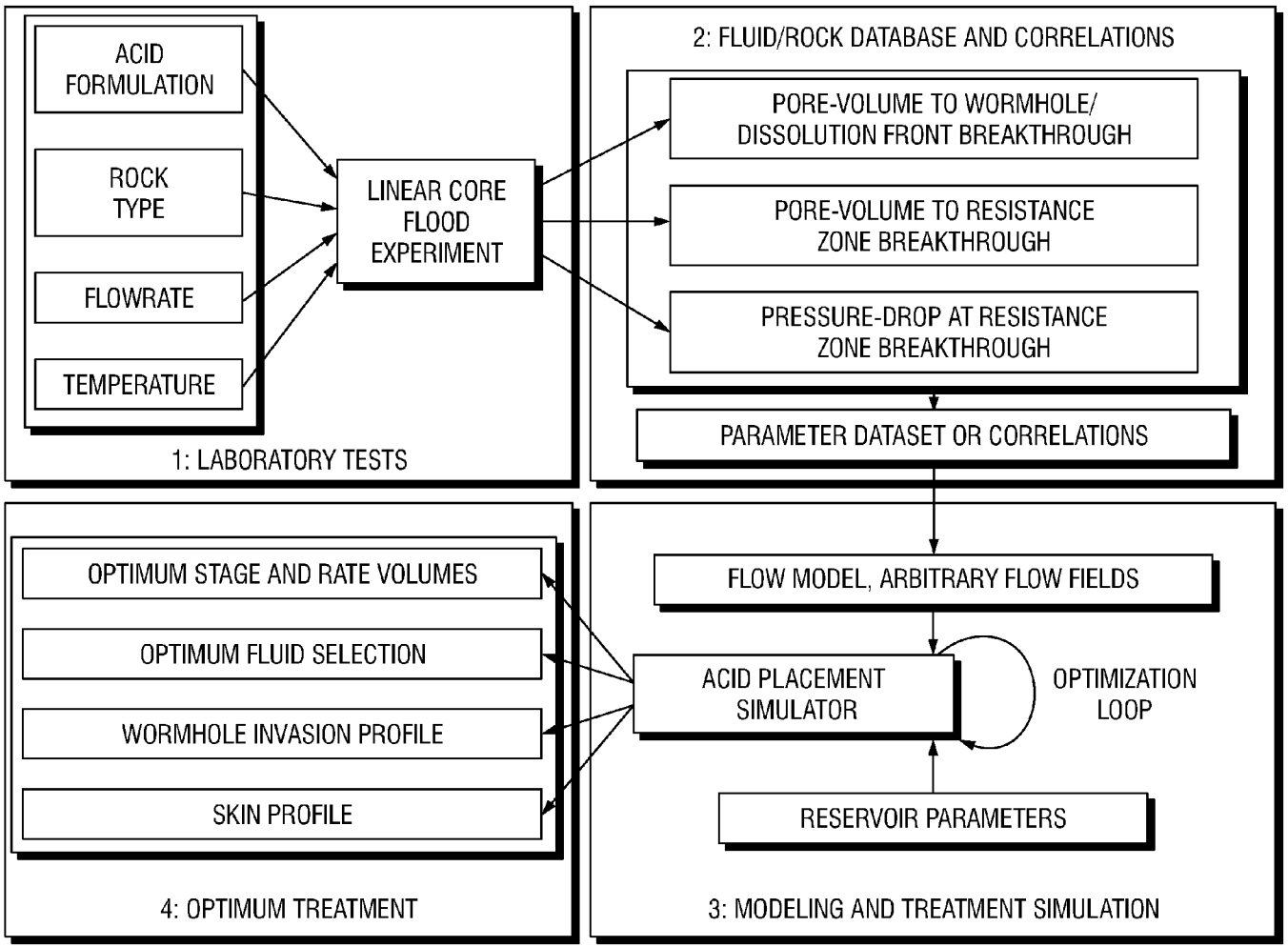
FIG. 19 shows a treatment design methodology in the field.

A global methodology used by field engineers is described in FIG. 19. The optimization in FIG. 19 makes use of the above methodology to predict a given acid treatment performance. It is possible to improve a design by Changing operational parameters such as:

- Pumping rate
- Acid volume
- Acid formulation
- Number of acid stages

Understanding important parameters controlling the treatment outcome such as:

- Operational parameters
- Reservoir parameters
- Wellbore parameters
- Conveyance parameters In various embodiments, the concepts detailed in this document are integrated into a software that solves the flow of acid around the wellbore, into the reservoir. Below is a non-limiting example of how this software is used.

EXAMPLE

Figure 20:
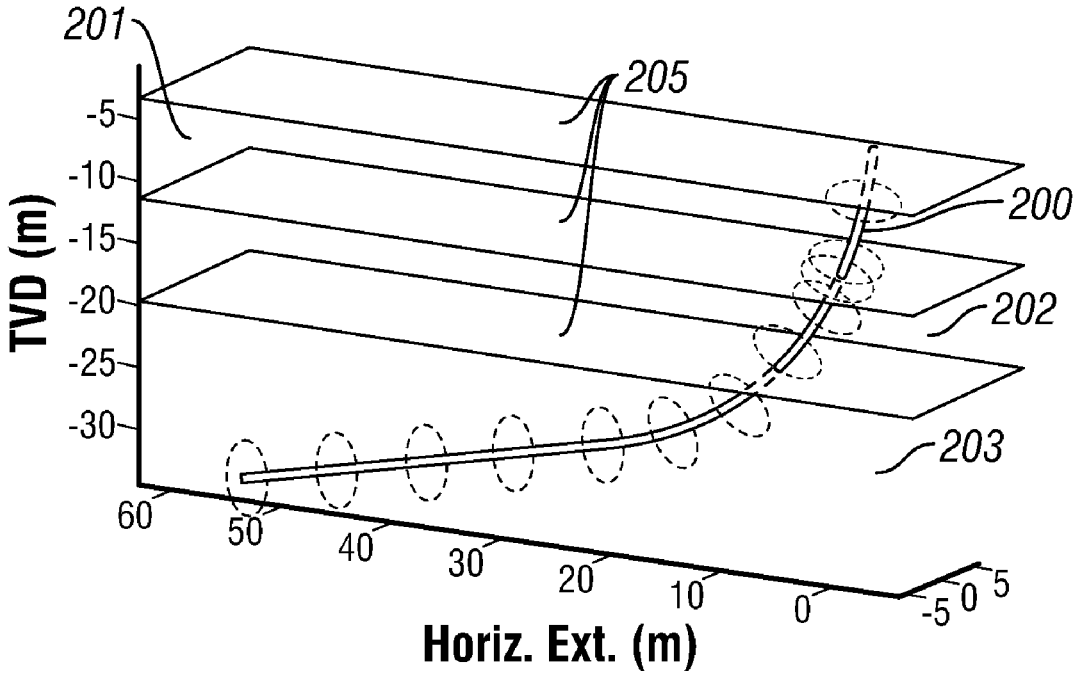
FIG. 20 shows a wellbore penetrating two (bottom and top) reservoir zones.

The example illustrated in FIG. 20 shows a well [200] crossing 2 producing zones of a reservoir bounded by flow barriers [205] separating the zones of flow. The top zone [201] of the reservoir has a horizontal permeability $k_h$ equal to 20 mD and is about 10 meters thick. The vertical permeability $k_v$ is 5 times smaller, equal to 4 mD. In this part of the reservoir, the wellbore trajectory forms an angle $\alpha$ varying between 0 and 20 degrees. Underneath the top zone, a non-permeable and non-producing zone [202] with a thickness of about 10 meters, is crossed by the well [200]. No flow will take place in this zone. Finally, at the bottom [203], the wellbore trajectory bends until an angle $\alpha$ around 78 degrees is reached. In this part of the reservoir, the horizontal permeability $k_h$ is 2 mD and the vertical permeability is 3 mD. The thickness of the bottom zone is about 22 meters.

The nature of the rock in the top and bottom zones [201] and [203] of the reservoir is known, and core flood experiments have been performed on cores extracted from these zones to assess the required flow parameters $\Theta_0$, $\Theta_r$ and $\Delta p_r$ to model the flow of the acids of interest.

In the top zone [201], Equation (24) dictates that the flow would be mostly horizontal (in the bedding plane) and therefore a radial flow model will be applied to simulate the flow of acid, similar to Equation (68). In the bottom zone [203], the wellbore is close to horizontal and Equation (24) determines that the flow will be mostly vertical. In this zone a flow model similar to (70) is therefore applied.

The wellbore is then divided into multiple segments, and the reservoir in multiple layers in a way similar to FIG. 9. The number of segments, and therefore layers, is selected by the engineer and is large enough for him to believe that the reservoir is discretized accurately enough.

Figure 21A:
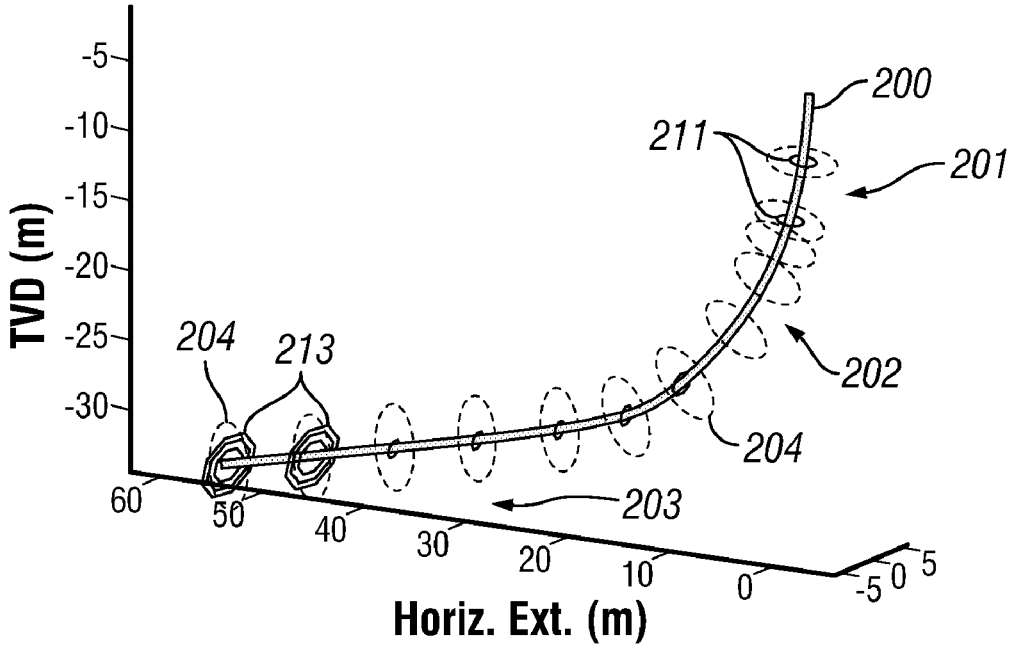
FIG. 21 shows a depth of invasion of the wormhole for 4 different injected volumes: 21*a*: 25 gal/ft; 21*b*: 50 gal/ft; 21*c*: 75 gal/ft; 21*d*: 100 gal/ft.
Figure 21B:
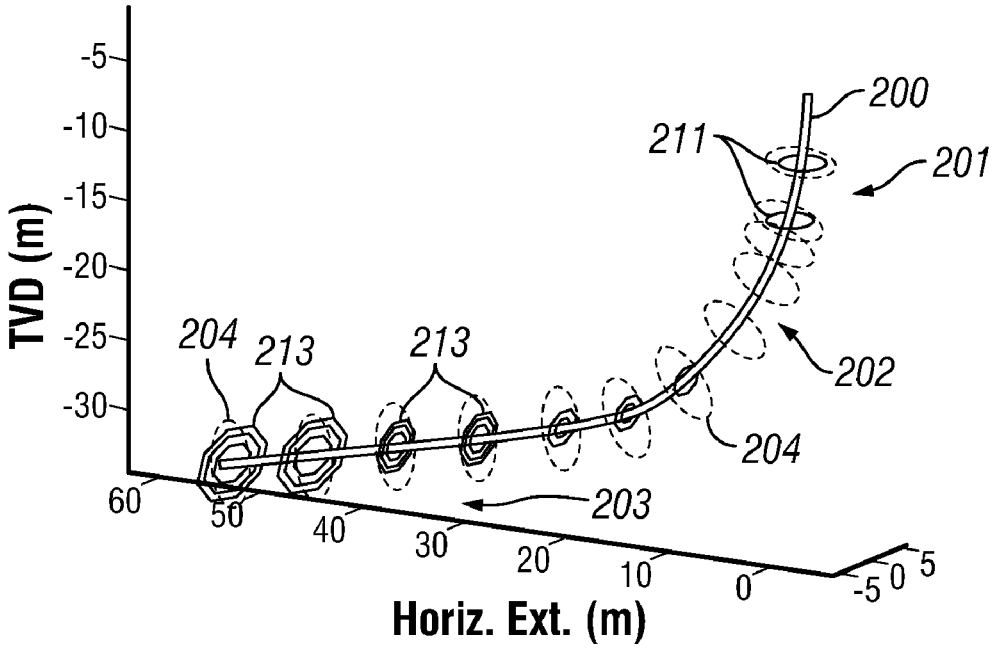
Figure 21C:
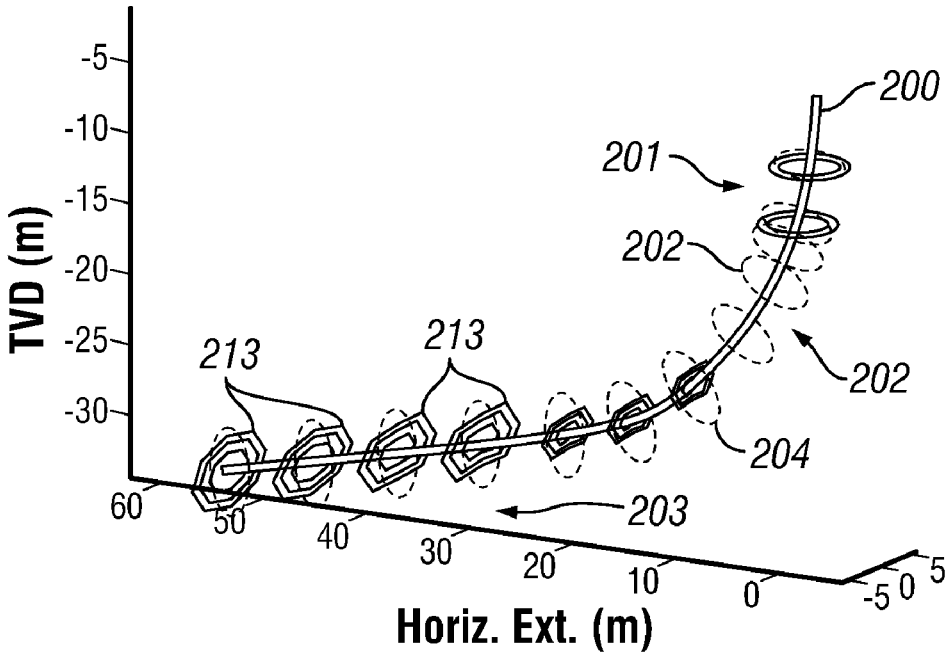
Figure 21D:
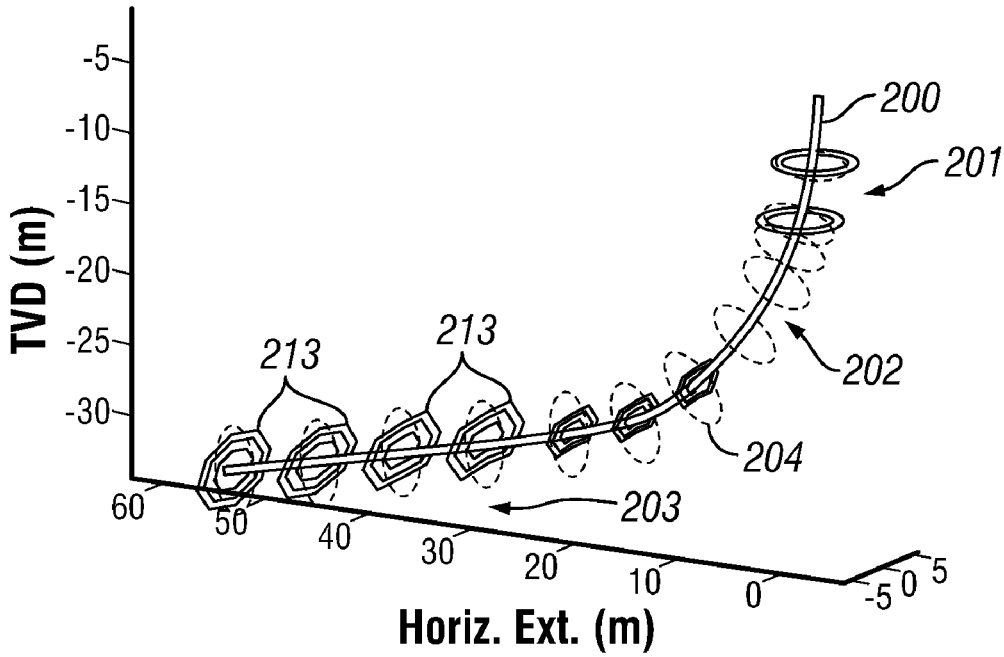

In the layers within the bottom zone of the reservoir, streamlines are computed according to the procedure described above. The interface at the top of the bottom zone due to the presence of the impermeable middle zone forms a flow barrier. Similarly, the bottom of the bottom zone is another flow barrier. Near the top of the bottom zone, the streamlines Then, the engineer starts the simulation consisting of pumping a certain volume of acid, 15% HCl in this case, for which he knows the values of the parameter $\Theta_0$ in the two zones [201] and [203] as mentioned above. The goal is to ensure that the wormholes formed by the acid will extent at least 5 meters away from the wellbore in order to obtain an optimum stimulation of the well. The depth of 5 meters is represented by the dashed lines around the wellbore [200] in FIG. 21, for scale reference. The original design consisted of pumping a volume of acid corresponding to 100 gallons per foot (approximately 1250 liters per meter) of wellbore length. The rate of injecting was fixed. FIG. 21 shows the evolution of the wormhole fronts in the top and bottom zone for four treatments: FIG. 21*a*—25 gal/ft; FIG. 21*b*—50 gal/ft; FIG. 21*c*—75 gal/ft; FIG. 21*d*—100 gal/ft. The top and bottom zones show various lines, each corresponding to the front formed by the tip of the wormholes at a given time. As time runs, the lines are deeper and deeper into the reservoir, showing that the wormholes extend into the reservoir. In the top zone [201], the front [211] formed by the tip of the wormholes is circular, due to radial flow. In the bottom zone [203], the contours formed by the fronts [213] of the wormhole tips are not circular due to the non radial flow obtained when flowing along the streamlines. In FIG. 21, these are shown as though there were 8 wormhole tips at each location at which the fronts are shown; series of octagons show the progression of the contours. Dotted lines [204] show where the front would be if flow were radial.

From FIG. 21, one can see that in order to reach the target depth of 5 m, in this case, 75 gal/ft (approximately 936 liters per meter) of acid is sufficient. It is therefore possible to reduce the cost of acid required to achieve the target. This is a result of the optimization loop illustrated in FIG. 19.

Figure 22:
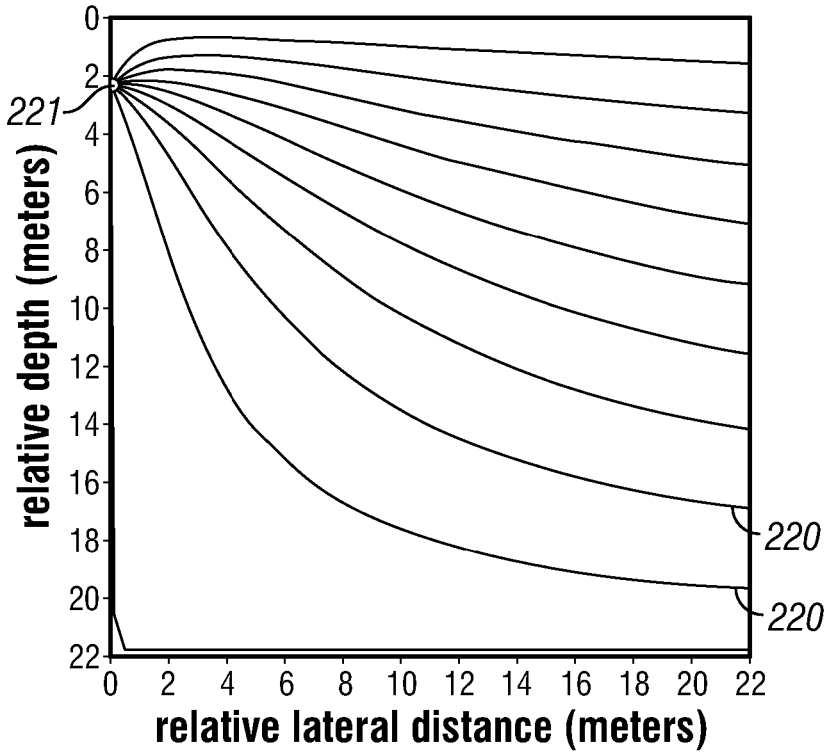
FIGS. 22 and 23 show streamlines calculated for flow around a wellbore.

FIG. 22 shows streamlines [220] originating from the well bore [221] in a layer close to the top of the bottom zone [203].

Figure 23:
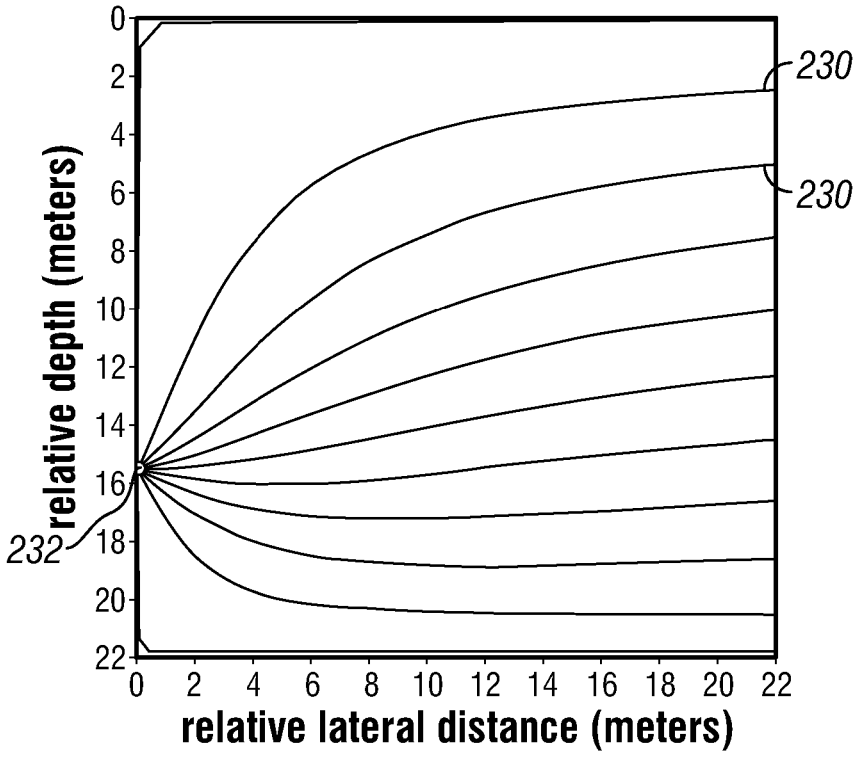

FIG. 23 show streamlines [230] originating from the well bore [232] in a layer closer to the bottom of the bottom zone [203].

I claim:

1. A method for solving the flow of acid from a wellbore segment to a corresponding reservoir layer during a matrix acidizing simulation, comprising:

a) Defining the initial geometry of the domain in which the flow problem is to be solved;

b) Determining the complex potential associated with the flow problem in the domain under consideration;

c) Determining streamlines from the complex potential in the domain under consideration;

d) Using the streamlines to solve flow over a time step $\delta t$ to propagate acid within the domain and update wormhole extent;

e) Updating the definition of the domain according to wormhole extent;

f) Updating the time;

g) Iterating as desired from step b).

2. A method according to claim 1, comprising determining the streamlines by a finite volume method.

3. A method according to claim 1, wherein the method includes simulation of the flow of a self-diverting acid.

4. A method of optimizing acid treatment of a hydrocarbon containing carbonate reservoir, comprising:

carrying out linear core flood experiments varying one or more parameters selected form the group consisting of acid formulation, rock type, flow rate, and temperature;

deriving the following functions from the experiments, as a function of the parameters:

$\Theta_o$ —the pore volume to wormhole/dissolution front breakthrough; and, if the acid formulation is a self-diverting acid:

$\Theta_r$—the pore volume to resistance zone breakthrough; and $\Delta p_r$—the pressure drop at resistance zone breakthrough;

solving the flow of acid from a wellbore segment to a corresponding reservoir layer during a matrix acidizing simulation by a process comprising:

a) defining the initial geometry of the domain in which the flow problem is to be solved;

b) determining the complex potential associated with the flow problem in the domain under consideration;

c) determining streamlines from the complex potential in the domain under consideration;

d) using the streamlines to solve flow over a time step & to propagate acid within the domain and update wormhole extent;

using the simulator in an optimization loop together with known and/or estimated reservoir parameters; and calculating at least one of the following from the simulator optimization loop:

stage and rate volumes of the acid treatment;

fluid selection for the acid treatment;

wormhole invasion profile; and skin profile.

5. A method according to claim 4, wherein the acid is a self diverting acid.

6. A method according to claim 4, comprising optimizing at least one of the pumping rate;

acid volume;

acid formulations; and number of acid stages.

7. A method according to claim 5, comprising optimizing at least one of the pumping rate;

acid volume;

acid formulations; and number of acid stages.

* * * * *